US008200102B2

(12) United States Patent
Zensai

(10) Patent No.: US 8,200,102 B2
(45) Date of Patent: Jun. 12, 2012

(54) IMAGE FORMING APPARATUS HAVING A DETACHABLE UNIT INCLUDING A FIRST ROTARY MEMBER AND A SECOND ROTARY MEMBER

(75) Inventor: Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 496 days.

(21) Appl. No.: 12/426,521

(22) Filed: Apr. 20, 2009

(65) Prior Publication Data

US 2009/0279905 A1 Nov. 12, 2009

(30) Foreign Application Priority Data

May 7, 2008 (JP) ..... 2008-120916

(51) Int. Cl.
*G03G 15/00* (2006.01)

(52) U.S. Cl. ..... 399/12; 399/13

(58) Field of Classification Search ..... 399/12, 399/13

See application file for complete search history.

(56) References Cited

U.S. PATENT DOCUMENTS 7,860,410 B2 * 12/2010 Tachiki et al. ..... 399/12
2006/0263102 A1 * 11/2006 Ishii ..... 399/12

FOREIGN PATENT DOCUMENTS

JP 6-118736 4/1994
JP 2001-296718 10/2001
JP 2006-235236 9/2006

* cited by examiner

*Primary Examiner* — David Gray
*Assistant Examiner* — Ruth Labombard
(74) *Attorney, Agent, or Firm* — Fitzpatrick, Cella, Harper & Scinto

(57) ABSTRACT

An image forming apparatus includes a unit, which is detachably attachable to a main body of the apparatus and has a portion to be detected, and a detecting device which detects the portion to be detected in the unit. It is determined that the unit is in an unused state since both of a first state in which the portion to be detected is detected by the detecting device and a second state in which the portion to be detected is not detected by the detecting device are confirmed, and thereafter, the first state or the second state is maintained. Furthermore, there is provided a restricting member which inhibits the first state or the second state from being maintained.

21 Claims, 23 Drawing Sheets

IMAGE FORMING APPARATUS HAVING A DETACHABLE UNIT INCLUDING A FIRST ROTARY MEMBER AND A SECOND ROTARY MEMBER

BACKGROUND OF THE INVENTION

1. Field of the Invention

The present invention relates to an image forming apparatus utilizing an electrophotographic system such as a copying machine or a facsimile and, more particularly, to an image forming apparatus having a unit detachably attachable to a main body of the apparatus and the unit.

2. Description of the Related Art

There has been conventionally an image forming apparatus utilizing an electrophotographic system in which a photosensitive drum, a cleaner, a development device, and the like disposed around the drum are unified as a so-called process cartridge, the unit being replaceable with respect to a main body of the image forming apparatus.

Like the process cartridge, a transfer belt unit constituted of a transfer roller and a belt member, which are adapted to transfer a toner image formed on an image bearing member (e.g., a photosensitive drum and an intermediate transfer belt) onto a transfer material, and a tension roller is a consumable. Therefore, the unit needs to be replaced with a new one when its life expires.

The image forming apparatus is provided with a counter which counts the speed of the belt member or the tension roller so as to notify a user of the need to replace the unit. When the count (i.e., a use history) of the counter reaches a predetermined value, an alert indicating the need to replace the unit concerned is displayed on a display in the image forming apparatus. Upon receipt of the alert, the user can replace the unit at a proper timing.

When the old unit is replaced with a new one, it is preferable that the past use history of the old transfer belt unit be reset, and then, a transfer voltage to be applied or the like be varied according to a new transfer belt unit. At this time, the user or a serviceman resets the use history on an operation portion. However, he or she may forget such work per se, and therefore, may not appropriately reset the use history.

In view of this, it is desirable that the new unit and the old unit be distinguishably detected, thereby securing the resetting work.

In the conventional image forming apparatus, there has been proposed a method for distinguishably determining a new process cartridge and an old process cartridge based on a fuse disposed therein. In this method, the old or new process cartridge is determined by detecting the electrically conducted state of the fuse in the process cartridge installed in the main body of the apparatus. When the process cartridge is determined to be a new one, the fuse is cut by predetermined initialization.

However, as described above, in the case where the fuse is cut by the predetermined initialization when the process cartridge is determined to be the new one, there have arisen the following problems.

For example, if a malfunction occurs in the image forming apparatus, it is necessary to identify whether the malfunction is caused by the main body of the image forming apparatus or the transfer belt unit. In this way, the serviceman who is requested to repair or investigate installs a new transfer belt unit in the main body of the image forming apparatus in question, and then, confirms operation, for the purpose of the diagnosis of the cause of the malfunction.

In this case, when the new transfer belt unit is installed in the apparatus, the image forming apparatus detects that the transfer belt unit installed is a new one, and then, performs the initialization of the transfer belt unit stored in the main body of the image forming apparatus. Then, the image forming apparatus adjusts parameters on the inside of a machine to values optimum for the new transfer belt unit, and further, cuts the fuse of the transfer belt unit. Thereafter, an image is output, and then, operation is confirmed. Here, in the case where the malfunction is caused by the old transfer belt unit, the old transfer belt unit is replaced with a new transfer belt unit.

In contrast, in the case where the malfunction is caused by the main body of the image forming apparatus, the above-described initialization erases the use history of the old transfer belt unit. In other words, even if the normal old transfer belt unit is installed again for use in the apparatus as a result of the investigation, the transfer belt unit cannot be used with optimum parameters.

In addition, the fuse of the transfer belt unit for use in troubleshooting has been cut already at the time of the installation irrespective of temporary use in investigating the cause of the malfunction. In this case, the transfer belt unit cannot be recognized to be a new one unless a fuse is replaced, thereby inducing many wastes.

In a configuration provided with a fuse member in the transfer belt unit, an electric contact portion is indispensable between the transfer belt unit and the main body of the apparatus, and therefore, the configuration becomes complicated in order to secure stable electric conductivity. Thus, an increase in the number of component parts inhibits cost reduction.

SUMMARY OF THE INVENTION

An object of the present invention is to provide an image forming apparatus and a detachably attachable unit, in which a main body of the apparatus and the unit can be kept in a proper state even if an inspection is carried out with a new unit for the purpose of a diagnosis of a cause of a malfunction in the case where an abnormality occurs in the image forming apparatus provided with the unit.

Another object of the present invention is to provide an image forming apparatus including: a unit detachably attachable to a main body of the apparatus, wherein said unit includes a portion to be detected; a detecting device which detects the portion to be detected in said unit, wherein it is determined that said unit is in an unused state based on that both of a first state in which said portion to be detected is detected by said detecting device and a second state in which said portion to be detected is not detected by said detecting device are confirmed, then said first state or the second state is maintained; and a restricting member which inhibits said first state or said second state from being maintained.

Still another object of the present invention is to provide a unit detachably attachable to an image forming apparatus, including: a portion to be detected which is detected by a detecting device, wherein it is determined that said unit is in an unused state based on that both of a first state in which said portion to be detected is detected by said detecting device and a second state in which said portion to be detected is not detected by said detecting device are confirmed, then the first state or the second state is maintained; and a restricting member which inhibits said first state or said second state from being maintained.

Further features of the present invention will become apparent from the following description of exemplary embodiments with reference to the attached drawings.

DESCRIPTION OF THE EMBODIMENTS

An image forming apparatus according to embodiments of the present invention will be described below in detail with reference to the attached drawings.

First Embodiment

[General Configuration of Image Forming Apparatus]

Figure 1:
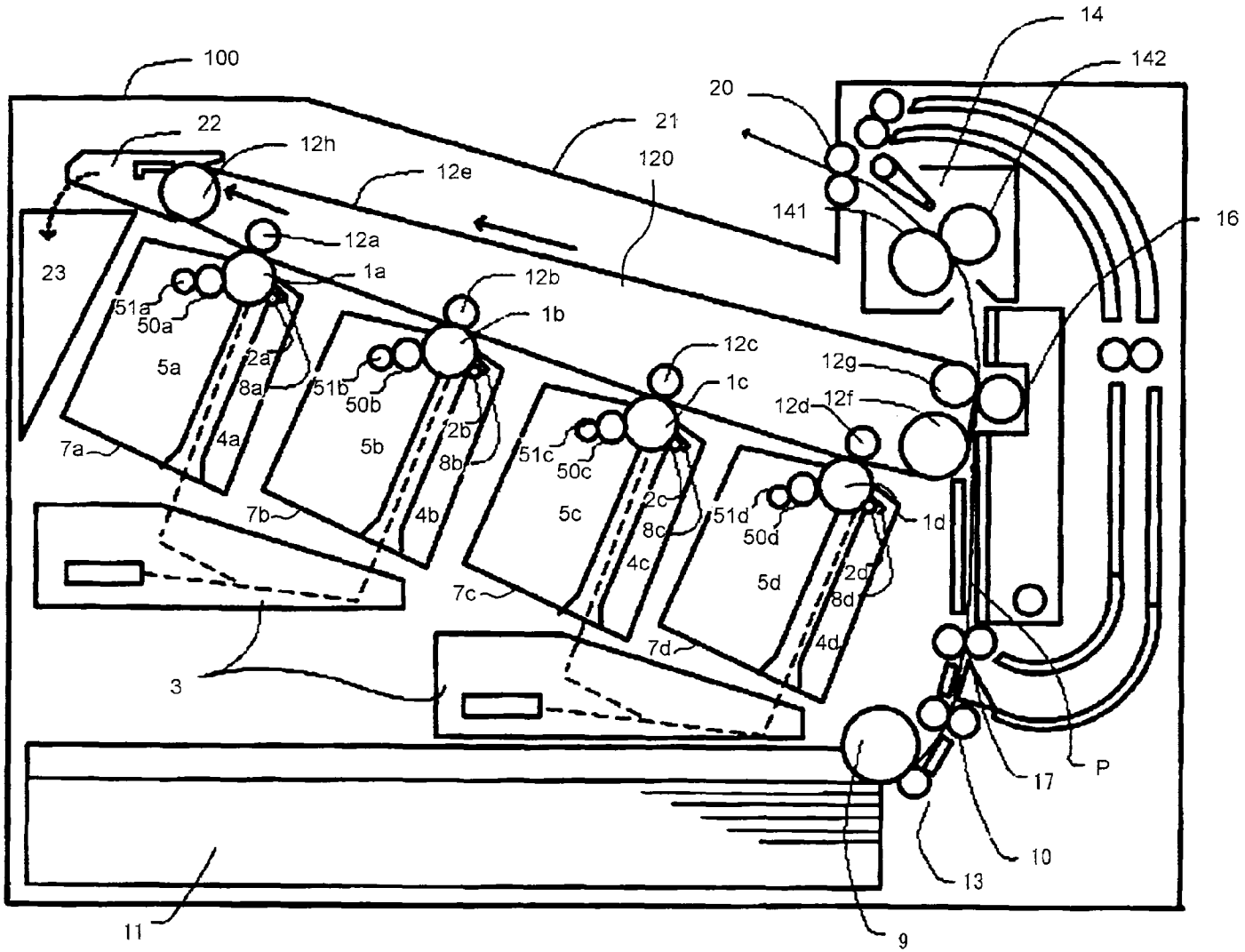
FIG. 1 is a cross-sectional view illustrating an image forming apparatus according to an embodiment of the present invention.

A color image forming apparatus illustrated in FIG. 1 is provided with process cartridges 7 (7*a*, 7*b*, 7*c*, and 7*d*) detachably attached to a main body 100 of the image forming apparatus.

The process cartridges are adapted to sequentially form yellow, magenta, cyan, and black images, respectively, wherein they are identical to each other in configuration except toners of different colors. Members a, b, c, and d illustrated in FIG. 1 correspond to image forming portions for yellow, magenta, cyan, and black, respectively. Hereinafter, reference characters a, b, c, and d will be omitted unless the colors need to be particularly distinguished.

The process cartridges 7 include drum units 4 (4*a*, 4*b*, 4*c*, and 4*d*) and development units 5 (5*a*, 5*b*, 5*c*, and 5*d*), respectively. Here, the drum units 4 include photosensitive drums 1 (1*a*, 1*b*, 1*c*, and 1*d*) serving as image bearing members, charge rollers 2 (2*a*, 2*b*, 2*c*, and 2*d*), drum cleaning blades 8 (8*a*, 8*b*, 8*c*, and 8*d*), and waste toner containers, respectively. The development units 5 include development rollers 50 (50*a*, 50*b*, 50*c*, and 50*d*) and developer applying rollers 51 (51*a*, 51*b*, 51*c*, and 51*d*), respectively.

Disposed under the process cartridges 7 are scanner units 3 which expose each of the photosensitive drums 1 to light based on image signals.

The photosensitive drums 1 are electrically charged to a predetermined potential of a negative polarity by the charge rollers 2, and then, electrostatic latent images are formed thereon by the scanner units 3. The electrostatic latent images are reversely developed by the development units 5 with the application of toners of a negative polarity, and thus, yellow, magenta, cyan, and black toner images are formed.

In a transfer belt unit 120 constituted by unifying an intermediate transfer belt (i.e., an intermediate transfer member), an intermediate transfer belt 12*e* serving as an endless belt member is stretched across a drive roller 12*f*, a secondary transfer counter roller 12*g*, and a tension roller 12*h*. The tension roller 12*h* is urged in a direction indicated by an arrow B, to apply a tension onto the intermediate transfer belt 12*e*. Moreover, primary transfer rollers 12 (12*a*, 12*b*, 12*c*, and 12*d*) are arranged inside of the intermediate transfer belt 12*e* in a manner facing the photosensitive drums 1, respectively. In this way, a transfer bias is designed to be applied by a bias applying unit, not illustrated.

In forming images, the photosensitive drums 1 are rotated, so that the intermediate transfer belt 12*e* is moved in a direction indicated by an arrow A. The toner images formed on the photosensitive drums 1 are transferred in sequence onto the intermediate transfer belt 12*e* with the application of a bias of a positive polarity to the primary transfer rollers 12, thereby conveying the intermediate transfer belt 12*e* having the toner images of the four colors formed in superimposition to a secondary transfer portion 15.

A sheet feeder 13 includes a feed roller 9 which feeds a transfer material P from a sheet cassette 11 containing the transfer material P serving as a recording material, and conveying rollers 10 which convey the fed transfer material P. The transfer material P conveyed from the sheet feeder 13 is further conveyed to the secondary transfer portion 15 by a pair of registration rollers 17.

In the secondary transfer portion 15, a bias of a positive polarity is applied to a secondary transfer roller 16, thereby secondarily transferring, onto the conveyed transfer material P, the toner images of the four colors formed on the intermediate transfer belt 12*e*.

The transfer material P having the toner images transferred thereon is conveyed to a fixing device 14, in which the material is then heated and pressurized by a fixing roller 141 and a pressure roller 142, to have the toner images fixed thereon. The fixed transfer material P is discharged onto a discharge tray 21 by a pair of discharge rollers 20.

Meanwhile, the toners remaining on the photosensitive drums 1 after the toner images are transferred are removed by the cleaning blades 8 (8*a*, 8*b*, 8*c*, and 8*d*). Furthermore, the toner remaining on the intermediate transfer belt 12*e* after the secondary transfer onto the transfer material P is removed by an intermediate transfer belt cleaner 22. The removed toner passes a waste toner conveyance path, not illustrated, (as indicated by a broken arrow in FIG. 1), to be recovered to a waste toner recovery vessel 23.

[Abutment/Separation Mechanism of Intermediate Transfer Belt]

Subsequently, an abutment/separation mechanism of the intermediate transfer belt in the image forming apparatus according to the present embodiment will be described below with reference to FIGS. 2 to 8B. Members designated by reference characters R and L in the drawings correspond to the right and left in a widthwise direction of the intermediate transfer belt (i.e., in a direction perpendicular to a movement direction), but reference characters R and L are omitted if the right and the left need not be particularly distinguished.

In the color image forming apparatus in the present embodiment, the intermediate transfer belt 12*e* can abut against or be separated from the photosensitive drums 1 in the process cartridges 7. Therefore, three modes described below can be selected in recording.

A first mode signifies a color mode (a full abutment mode) in which the intermediate transfer belt 12*e* abuts against all of the photosensitive drums 1, thereby achieving multi-color recording in superimposition of the plurality of colors. A second mode signifies a monochromatic mode in which the intermediate transfer belt 12*e* abuts against only one photosensitive drum 1, thereby achieving monochromatic recording. A third mode signifies a full separation mode in which the intermediate transfer belt 12*e* is separated from all of the photosensitive drums 1.

Figure 2:
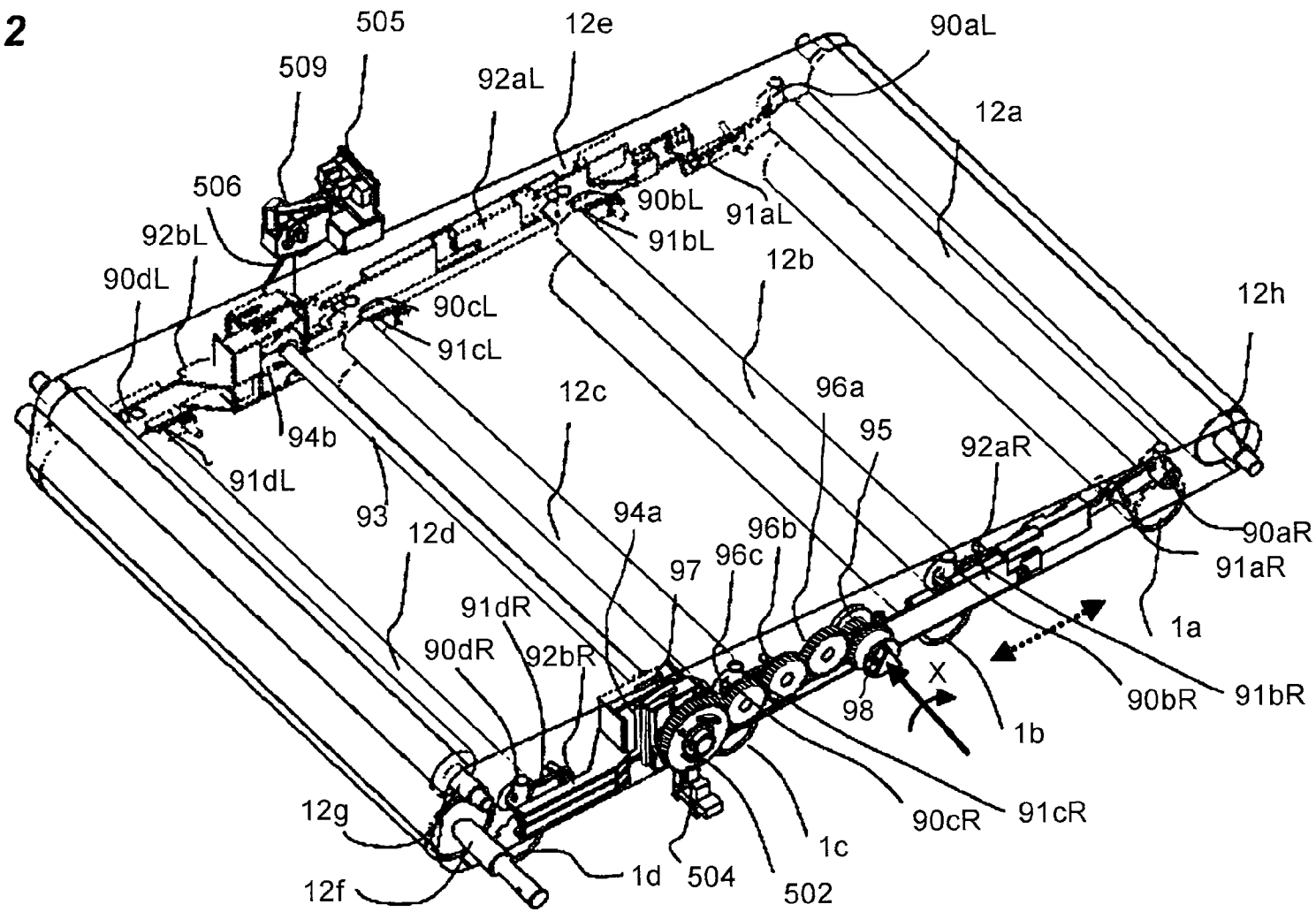
FIG. 2 is a perspective view illustrating a transfer belt unit to be installed in the image forming apparatus.

FIG. 2 is a perspective view illustrating the schematic configuration of the transfer belt unit 120, wherein the photosensitive drums 1 face the transfer belt unit 120. The transfer belt unit 120 is detachably attachable to the main body of the apparatus. When the transfer belt unit 120 is consumed due to the use, it can be replaced with a new one.

The mechanism, which allows the intermediate transfer belt 12*e* and the four primary transfer rollers 12*a*, 12*b*, 12*c*, and 12*d* to abut against or be separated from the photosensitive drums 1, is housed in a space defined by the three tension rollers, that is, the drive roller 12*f*, the driven roller 12*g*, and the tension roller 12*h*.

Drive force is transmitted from the main body 100 of the image forming apparatus to the transfer belt unit 120 via a coupling 98 by a drive output portion, not illustrated (as indicated by a solid straight arrow in FIG. 2). A first separation gear 95 engages with the coupling coaxially with the coupling 98. The first separation gear 95 is geared to a third separation gear 97 via second separation gears 96*a*, 96*b*, and 96*c* serving as three idler gears. Fixed coaxially with the third separation gear 97 are a separation shaft 93 and separation cams 94*a* and 94*b* at both ends of the shaft.

The number of teeth of the first separation gear 95 is 17, and further, the number of teeth of the third separation gear 97 is triple (a factor of a natural number), that is, 51. Thus, one rotation of the coupling 98 and ⅓ rotation of the third separation gear 97 are controlled every ON/OFF of a solenoid by a chipped gear and a solenoid, neither illustrated, disposed upstream of the drive of the coupling 98.

The coupling 98 and the third separation gear 97 are rotated in a direction indicated by an arrow X in FIG. 2. As for the rotation control, the same function may be fulfilled by utilizing a rotational angle control by a stepping motor or a drive control unit such as an electromagnetic clutch, besides the configuration of the chipped gear and the solenoid.

First separation rods 92*a* and second separation rods 92*b* are arranged on both sides in a widthwise direction of the intermediate transfer belt 12*e*. These separation rods 92*a* and 92*b* are slidably fixed in the arrangement direction of the plurality of photosensitive drums 1 so as to allow the photosensitive drums 1 to abut against or be separated from the intermediate transfer belt 12*e*.

Separation rods 92*a*R and 92*b*R are connected to the separation cam 94*a* whereas separation rods 92*a*L and 92*b*L are connected to the separation cam 94*b*. The connected separation rods slide in substantially the same direction as the arrangement direction of the plurality of photosensitive drums 1 (as indicated by a broken arrow in FIG. 2) according to the rotation of the separation cams 94*a* and 94*b*.

Figure 3:
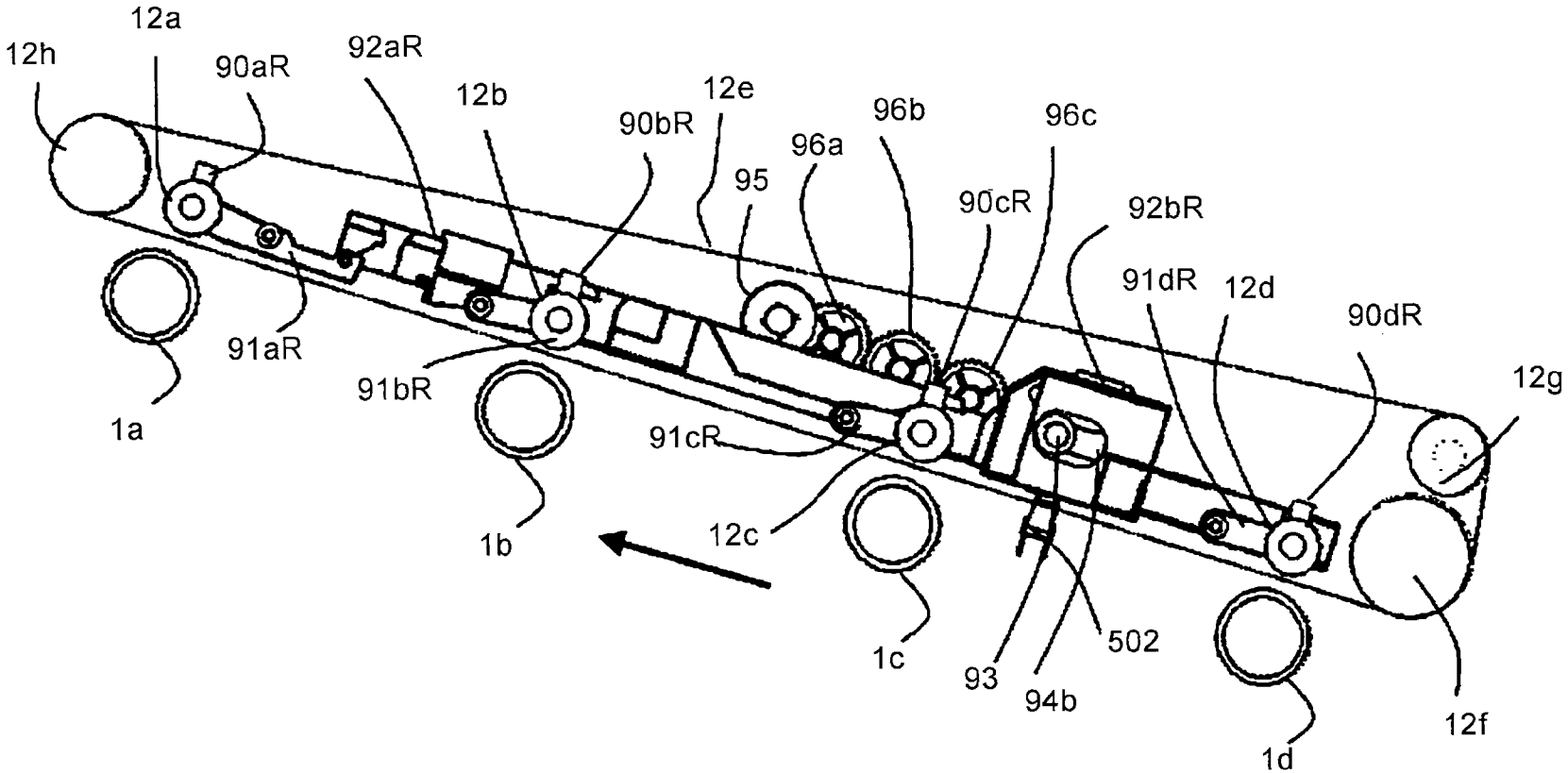
FIG. 3 is a view illustrating the abutment relationship between an intermediate transfer belt and an image bearing member in a full separation mode.
Figure 4:
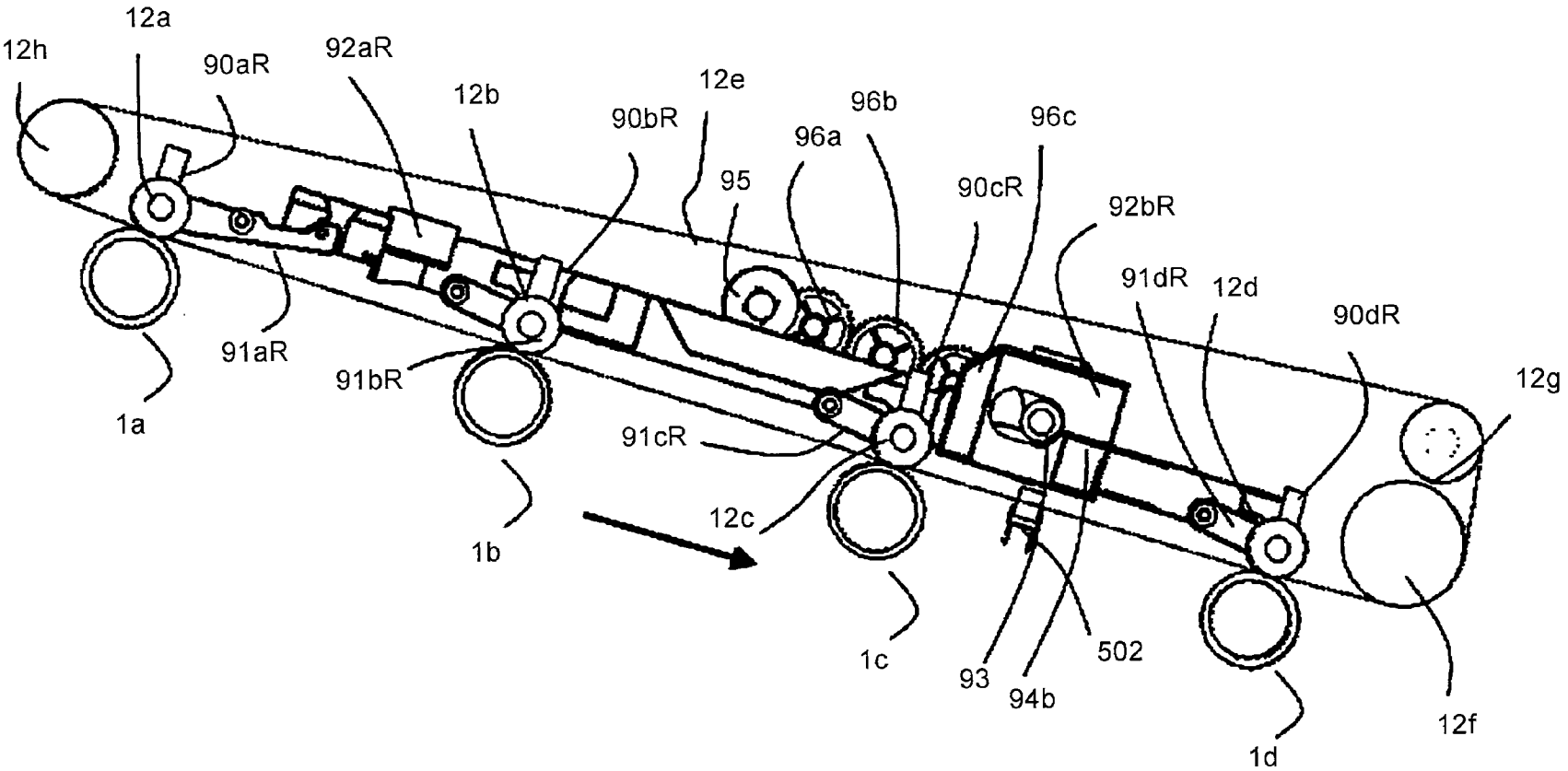
FIG. 4 is a view illustrating the abutment relationship between the intermediate transfer belt and the image bearing member in a full abutment mode.
Figure 5:
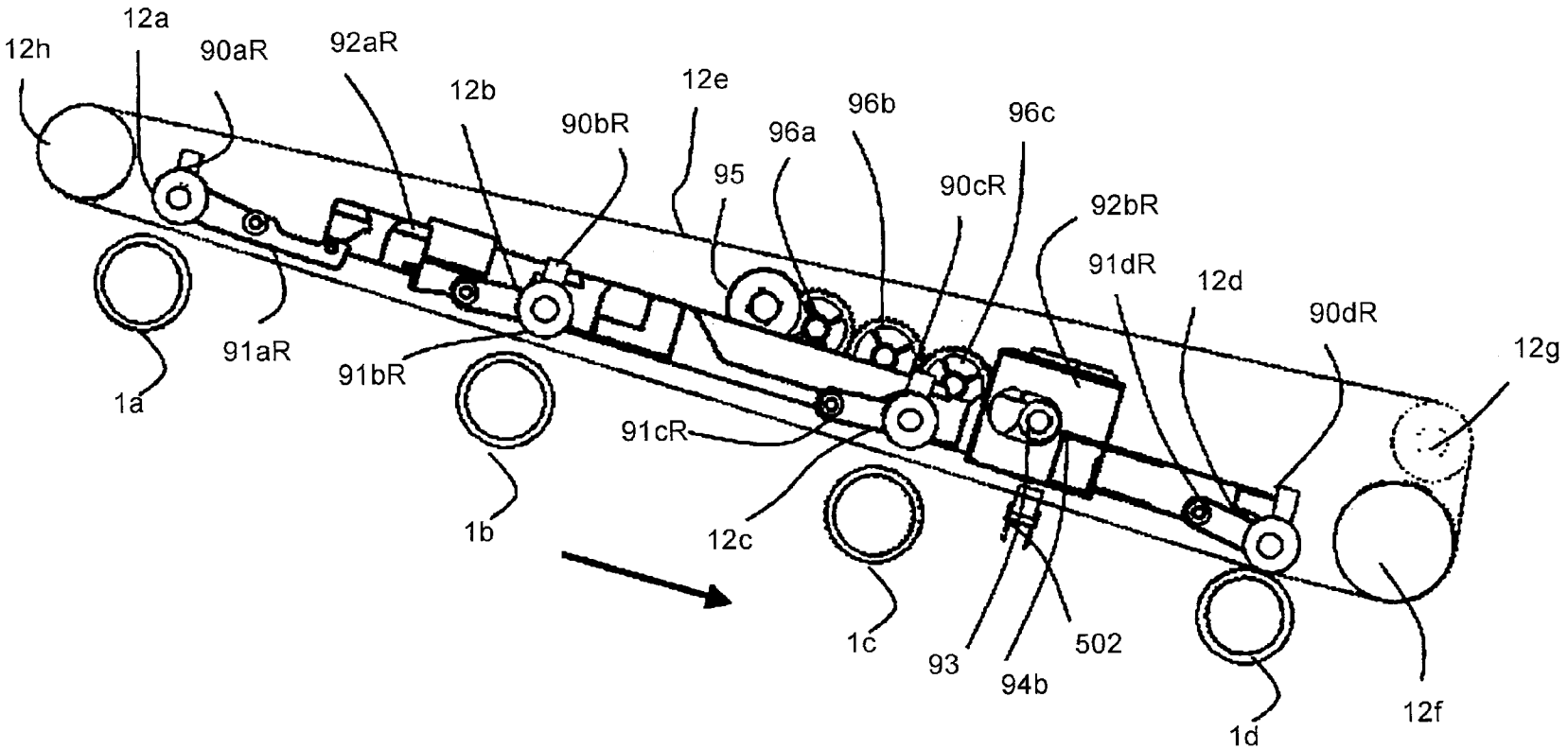
FIG. 5 is a view illustrating the abutment relationship between the intermediate transfer belt and the image bearing member in a monochromatic mode.

FIG. 3 is a cross-sectional view schematically illustrating the full separation mode (i.e., the third mode); FIG. 4 is another cross-sectional view schematically illustrating the full abutment mode (i.e., the first mode); and FIG. 5 is still another cross-sectional view schematically illustrating the monochromatic mode (i.e., the second mode).

At the time of OFF of a power source and in a standby status of the apparatus except the case of an abnormality such as an instant outage of power supply, the intermediate transfer belt 12*e* is separated in the full separation mode in which the transfer rollers 12 are retracted from the photosensitive drums 1 in the units of all of the colors in the present embodiment. This is because if the intermediate transfer belt 12*e* is left abutting against the photosensitive drums 1 for a long period of time, the intermediate transfer belt 12*e* or the transfer rollers 12 may be locally subjected to plastic deformation typified by "creeping," thereby degrading an image quality after the transfer belt 12*e* is left.

Securing a clearance can help avoid the mutual slide between the photosensitive drum 1 and the intermediate transfer belt 12*e* as much as possible at the time of the replacement of the process cartridge 7 or the transfer belt unit 120.

As described above, the ⅓ rotation control of the third separation gear 97 is achieved by the ON/OFF of the solenoid, so that the intermediate transfer belt 12*e* is shifted with respect to the photosensitive drums 1 in states illustrated in FIG. 2, FIG. 3, FIG. 4 and FIG. 2 in sequence. In other words, the full separation mode, the full color mode, the monochromatic mode, and the full separation mode (i.e., the original full separation mode) are transited in sequence every one rotation of the coupling 98 in the direction indicated by the arrow X in FIG. 2.

The above-described configuration will be specifically described with reference to FIGS. 3 to 5. The separation rods 92*a* and 92*b* slide in the direction substantially parallel to the arrangement direction of the photosensitive drums 1 (i.e., in the direction indicated by arrows in the drawings) via the third separation gear 97 and the separation cam 94 upon the rotation of the first separation gear 95. As following the slide, the transfer rollers 12 are moved by moving transfer roller bearings 91 (91*a*R, 91*b*R, 91*c*R, 91*d*R, 91*a*L, 91*b*L, 91*c*L, and 91*d*L) forward or reversely in a pressurization direction of transferring/pressurizing springs 90 (90*a*R, 90*b*R, 90*c*R, 90*d*R, 90*a*L, 90*b*L, 90*c*L, and 90*d*L), thus achieving the abutment or separation between the photosensitive drums 1 and the intermediate transfer belt 12*e*.

Incidentally, the first separation rods 92*a* achieve the abutment or separation between the photosensitive drums 1*a*, 1*b*, and 1*c* in the image forming portions for the yellow, magenta, and cyan colors and the intermediate transfer belt 12*e*. In contrast, the second separation rods 92*b* achieve the abutment or separation between the photosensitive drum 1*d* in the image forming portion for the black color and the intermediate transfer belt 12*e*.

Here, the shifts of the separation rods 92*a* and 92*b* during the transition in each of the modes will be described below. During the transition from the full separation mode to the full color mode, the first separation rods 92*a* and the second separation rods 92*b* are moved in a direction indicated by the arrow in FIG. 3. Thus, all of the primary transfer rollers 12 abut against the intermediate transfer belt 12*e*, which in turn abuts against the photosensitive drums 1, as illustrated in FIG. 4.

Next, during the transition from the full color mode to the monochromatic mode, only the first separation rods 92*a* are moved in a direction indicated by the arrow in FIG. 4. Thus, the primary transfer rollers 12*a*, 12*b*, and 12*c* for the yellow, magenta, and cyan colors are separated from the intermediate transfer belt 12*e*, which in turn is separated from the photosensitive drum 1*a*, 1*b*, and 1*c*, as illustrated in FIG. 5.

During the transition from the monochromatic mode to the full separation mode, only the second separation rods 92*b* are moved in a direction indicated by the arrow in FIG. 5. In this manner, the primary transfer roller 12*d* for the black color also is separated from the intermediate transfer belt 12*e*, which also is separated from the photosensitive drum 1*d*, as illustrated in FIG. 3. In this manner, the mode is returned to the full separation mode.

The relationship between the separation rod 92 and the transfer roller bearing 91 will be described with reference to FIGS. 6, 7A, and 7B, which are partially enlarged views illustrating the separation rod 92 and the transfer roller bearing 91.

Figure 6:
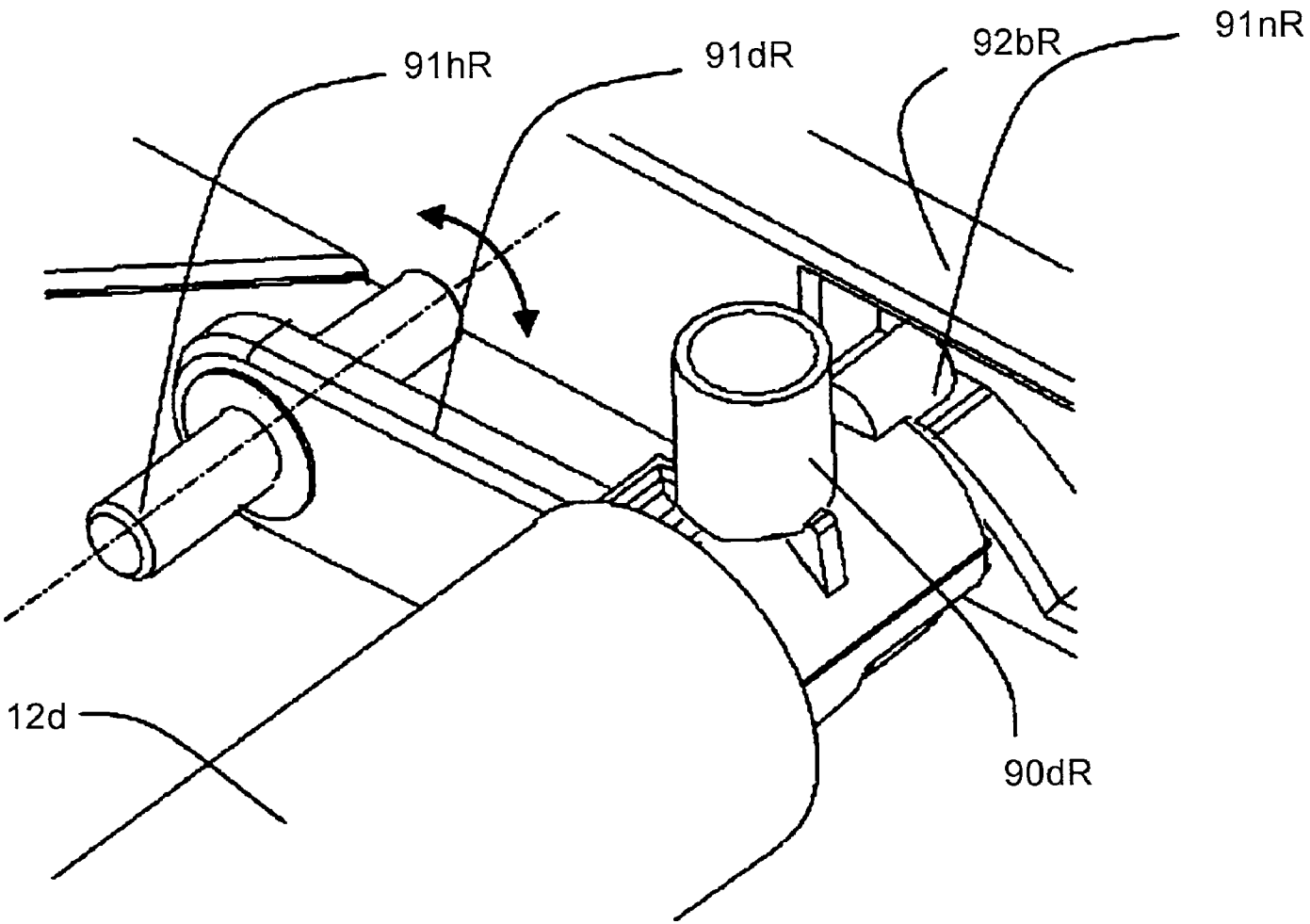
FIG. 6 is a partially enlarged perspective view illustrating a transfer roller bearing and a separation rod.
Figure 7B:
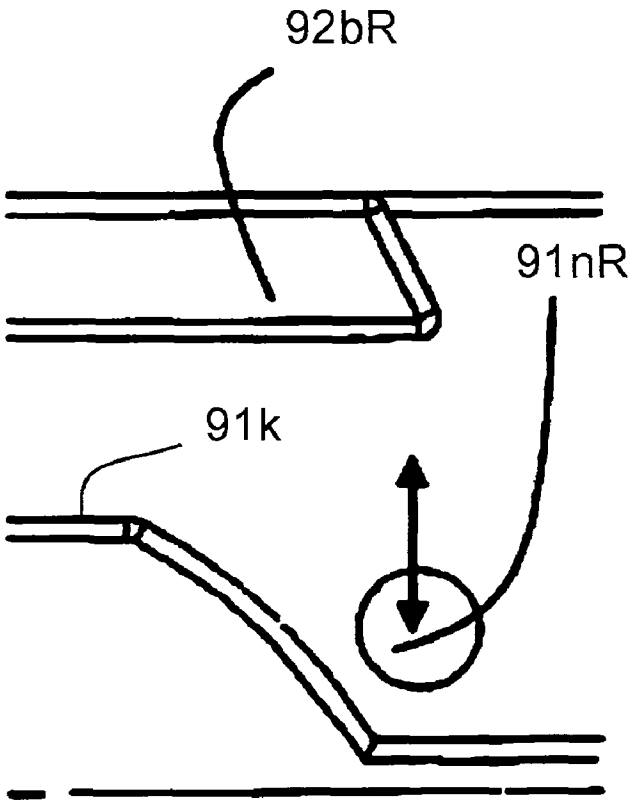
FIGS. 7A and 7B are views illustrating the abutment and the separation between the transfer roller bearing and the separation rod.
Figure 7A:
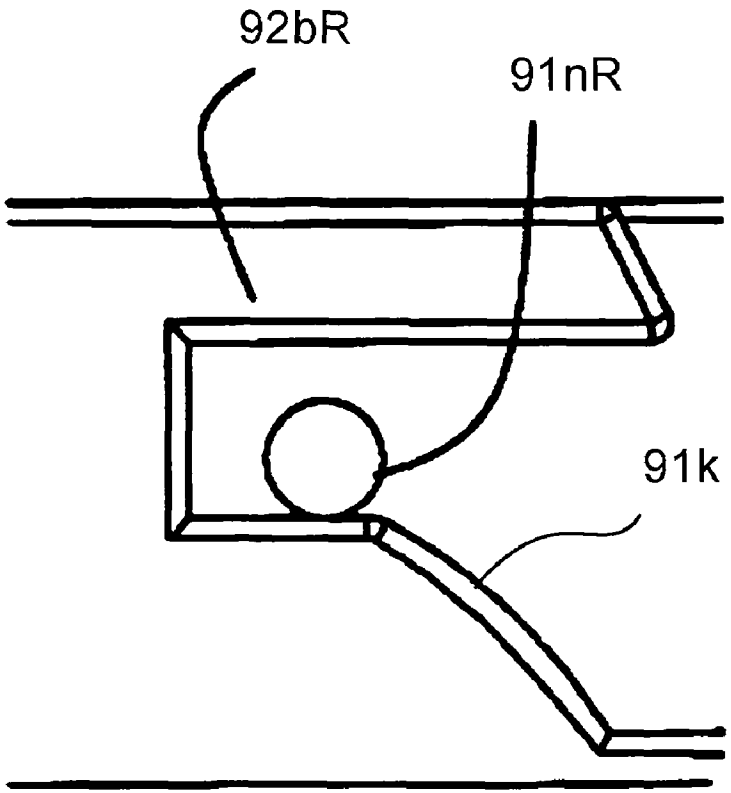

FIG. 6 illustrates a boss portion 91*n*R at the transfer roller bearing 91*d*R in the black image forming portion as a typical example mounted on a cam shaped portion (an inclined portion) 91*k* at the second separation rod 92*b*R. As described above, when the second separation rod 92*b* slides, the boss portion 91*n*R is oscillated on an oscillation center 91*h*R of the transfer roller bearing 91*d*R owing to the cam shape of the second separation rod 92*b*R, as indicated by an arrow in FIG. 6. As a consequence, the transfer roller bearing 91 and the primary transfer roller 12 are moved in a substantially vertical direction in FIGS. 7A and 7B, thereby achieving the abutment against or separation from the intermediate transfer belt 12*e*. Incidentally, FIG. 7A illustrates the separation status whereas FIG. 7B illustrates the abutment status.

Subsequently, the configuration of an abutment/separation detecting unit which is adapted to detect the abutment or separation between the intermediate transfer belt 12*e* and the photosensitive drum 1 will be described with reference to FIGS. 8A and 8B.

Figure 8B:
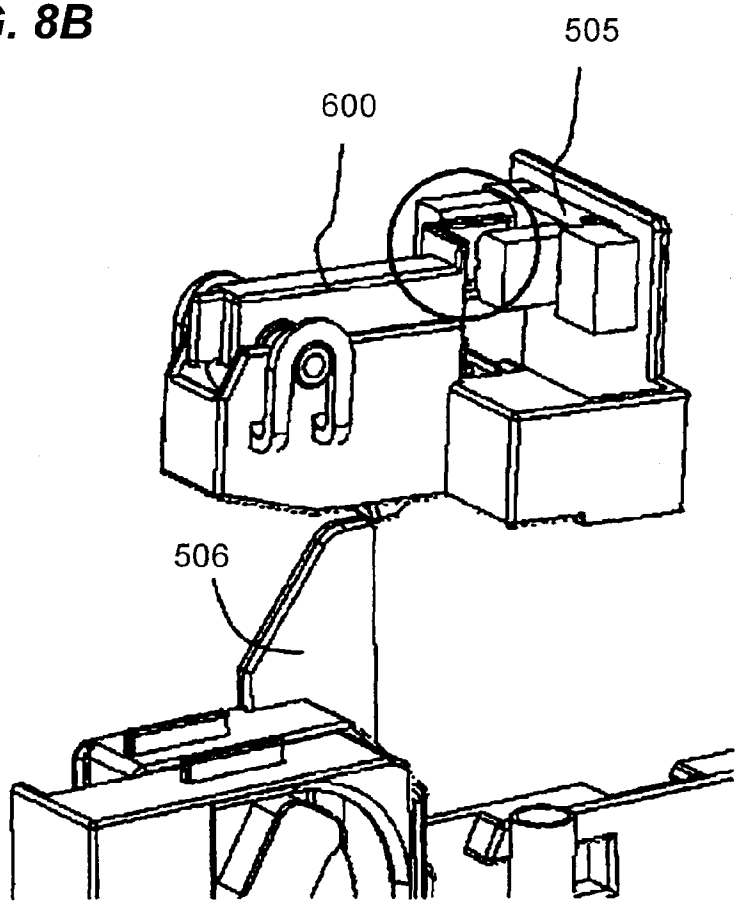
FIGS. 8A and 8B are views illustrating an abutment/separation detecting mechanism for the intermediate transfer belt.
Figure 8A:
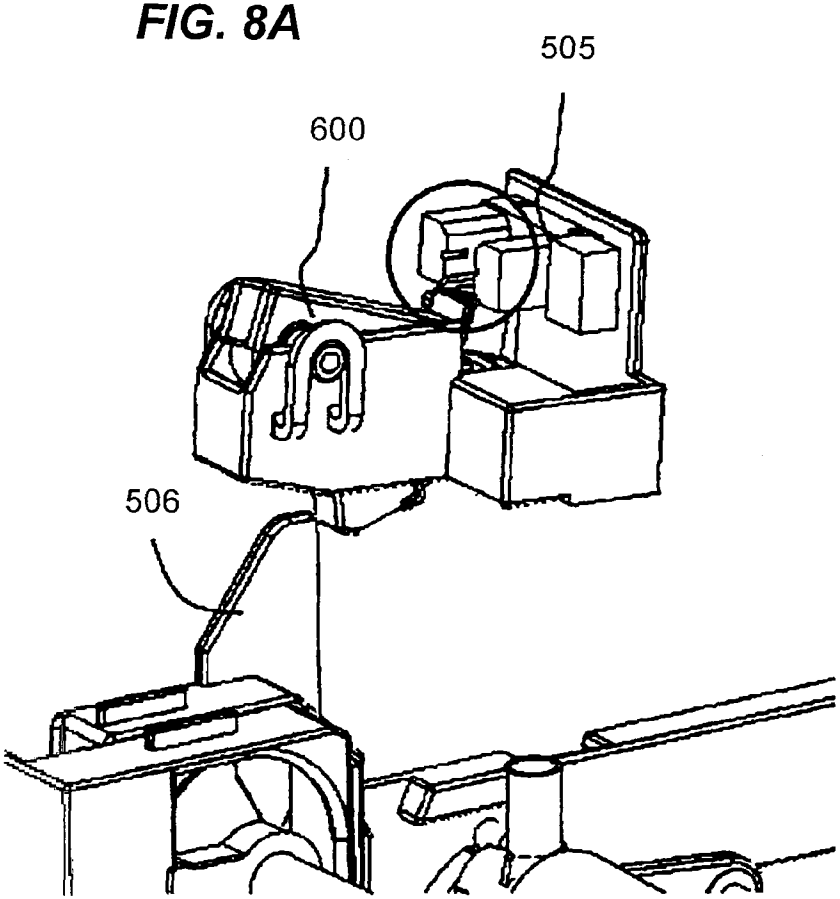

As illustrated in FIGS. 8A and 8B, an abutment/separation detecting member 506 is disposed on the side of the transfer belt unit 120 whereas an abutment/separation detecting sensor 505 and an abutment/separation detecting flag 600 are disposed on the side of the main body 100 of the image forming apparatus. Here, the abutment/separation detecting sensor 505 is exemplified by a photointerrupter in the present embodiment. FIG. 8A illustrates a detection status in the monochromatic mode and the full separation mode whereas FIG. 8B illustrates a detection status in the full color mode.

The abutment/separation detecting member 506 disposed at a part of the first separation rod 92*a*L does not push up the abutment/separation detecting flag 600, so as not to intercept the sensor in the modes other than the first mode (FIG. 8A). In contrast, the abutment/separation detecting member 506 pushes up the abutment/separation detecting flag 600 according to the slide of the first separation rod 92*a*L, so as to intercept the sensor in the first mode (FIG. 8B).

The movements of the drive train from the coupling 98 to the separation cam 94 and the separation rod 92 are uniquely determined in such a manner as to intercept the abutment/separation detecting sensor 505 only in the first mode except the malfunction of the sensor per se or the abutment/separation detecting member 506, thereby securing the relationship between these phases.

[Mechanism for Detecting New Transfer Belt Unit]

Next, a new unit detecting mechanism which detects whether or not the transfer belt unit 120 is replaced with a new one will be described with reference to FIGS. 2, 9A, and 9B to 12B.

As illustrated in FIG. 2, a new unit detecting mechanism in the present embodiment is exemplified by a new unit detecting member 502 serving as a rotary member which detects whether or not the transfer belt unit 120 is new, the member 502 being disposed coaxially with the rotary shaft of the third separation gear 97; and a new unit detecting sensor 504 serving as a detecting device which detects the new unit detecting member 502, the sensor 504 being disposed in the vicinity of the new unit detecting member 502. Here, the new unit detecting sensor 504 is exemplified by a photointerrupter in the present embodiment.

In the present embodiment, there is provided a moving unit which moves the new unit detecting member 502 at a non-association position at which it cannot be associated with the transition of the belt unit due to the mode switch after the new unit detecting member 502 is moved in association with the first mode switch after the transfer belt unit 120 is installed in the main body of the apparatus. In this manner, it is determined whether or not the transfer belt unit 120 is new by detecting the new unit detecting member 502.

Figure 9B:
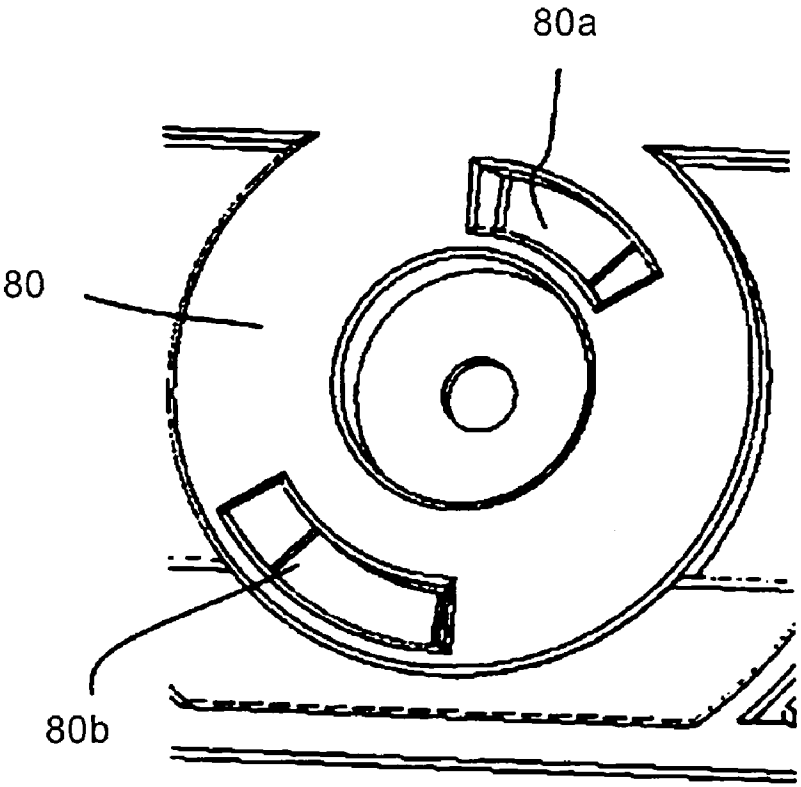
FIGS. 9A and 9B are enlarged views illustrating part of a new transfer belt unit detecting member and a unit frame.
Figure 9A:
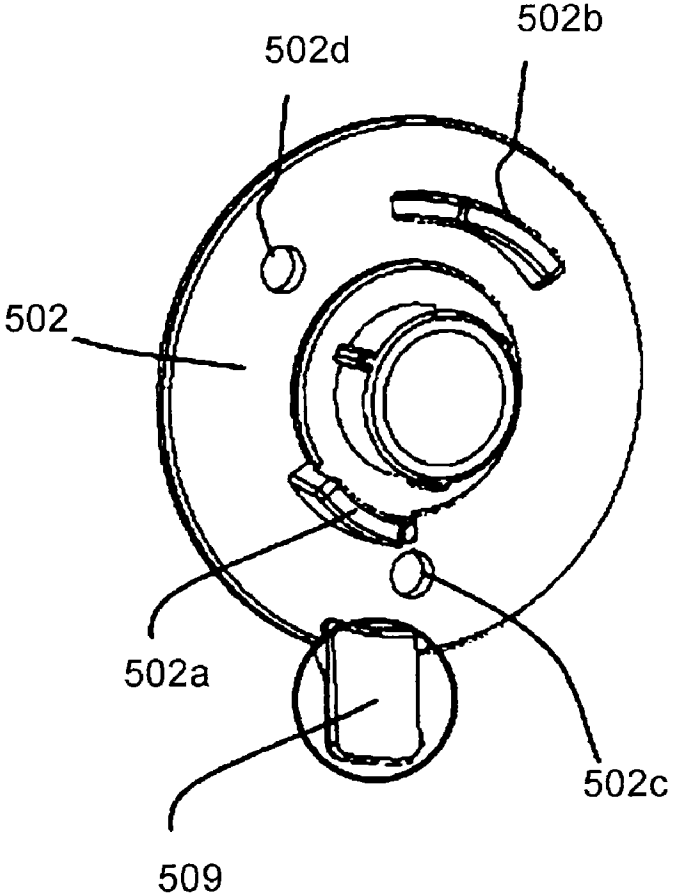

FIG. 9A is an enlarged view illustrating the new unit detecting member 502. In the new unit detecting member 502, a flag portion 509 to be detected projects from a disk-like member, and further, holes 502*c* and 502*d* are bored at positions deviated from the rotational center. At the side surface of the new unit detecting member 502, cam portions 502*a* and 502*b* are formed into a cam shape gradually projecting in a direction of the rotary shaft and concentrically with the rotational center.

The flag portion 509 is adapted to intercept the light incident into the sensor 504. The holes 502*c* and 502*d* engage with boss portions 97*a* and 97*b* disposed at the side surface of the third separation gear 97 (FIGS. 10A and 10B), so that the new unit detecting member 502 can be rotated integrally with the third separation gear 97. In addition, the cam portions 502*a* and 502*b* abut against a frame 80 of the transfer belt unit.

As illustrated in FIG. 9B, cam shaped portions 80*a* and 80*b* in conformity with the cam portions 502*a* and 502*b* are disposed at a part of the frame 80 of the transfer belt unit.

Figure 10B:
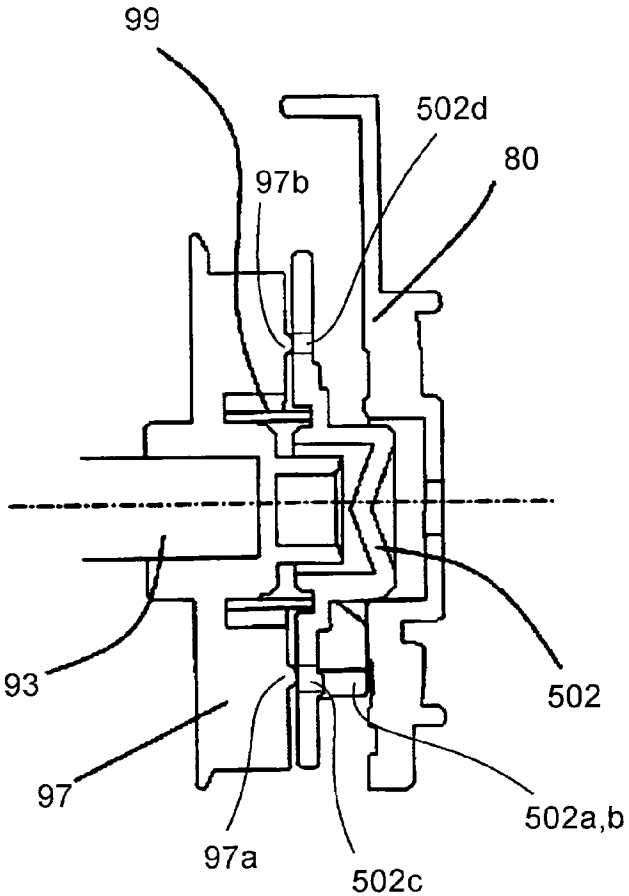
FIGS. 10A and 10B are views illustrating a new transfer belt unit detecting mechanism which detects a new transfer belt unit (in the full separation mode)
Figure 10A:
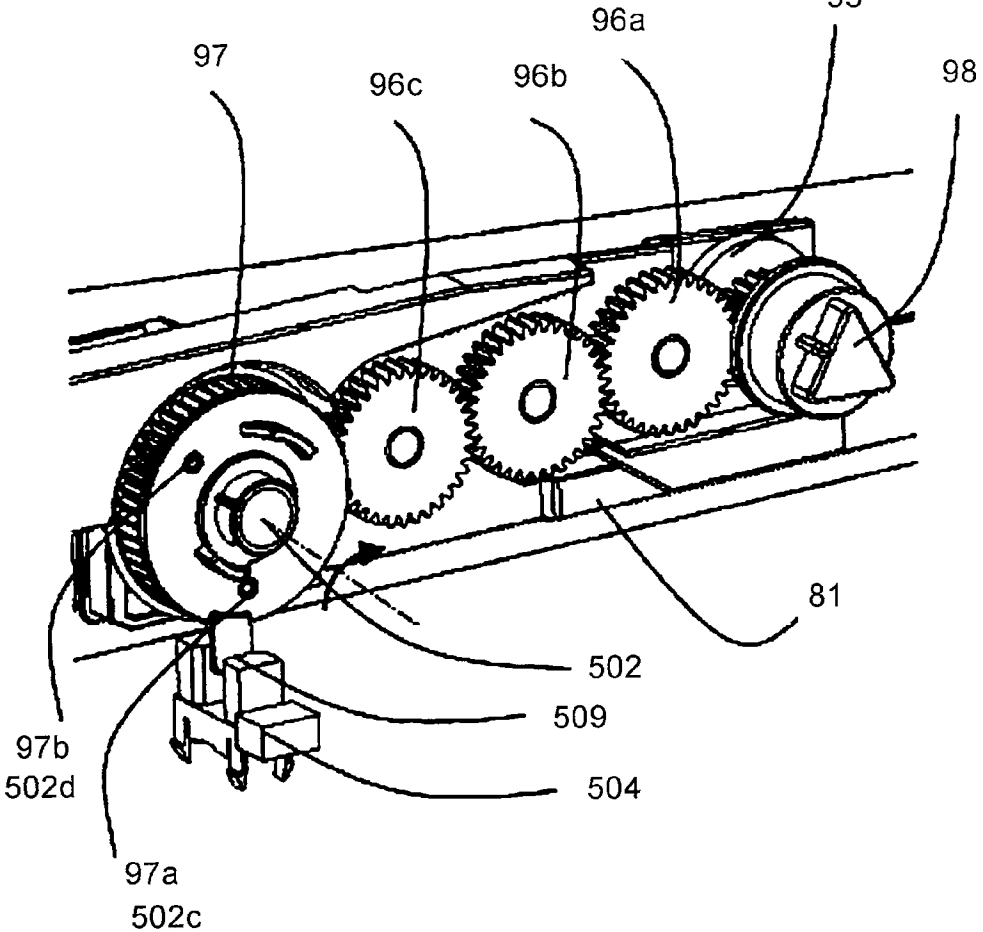
Figure 11B:
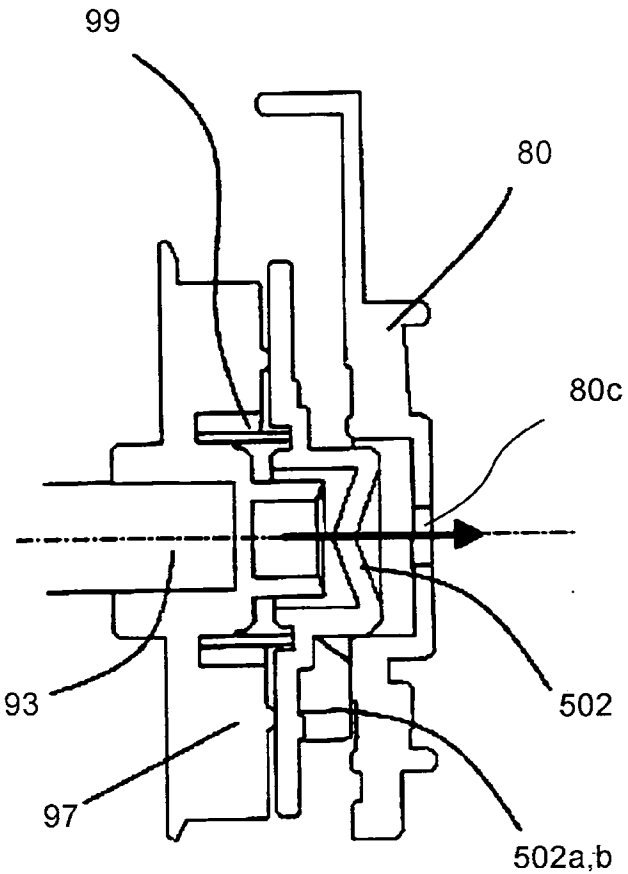
FIGS. 11A and 11B are views illustrating the new transfer belt unit detecting mechanism immediately before the switch from the detection of the new transfer belt unit to the detection of an old transfer belt unit.
Figure 11A:
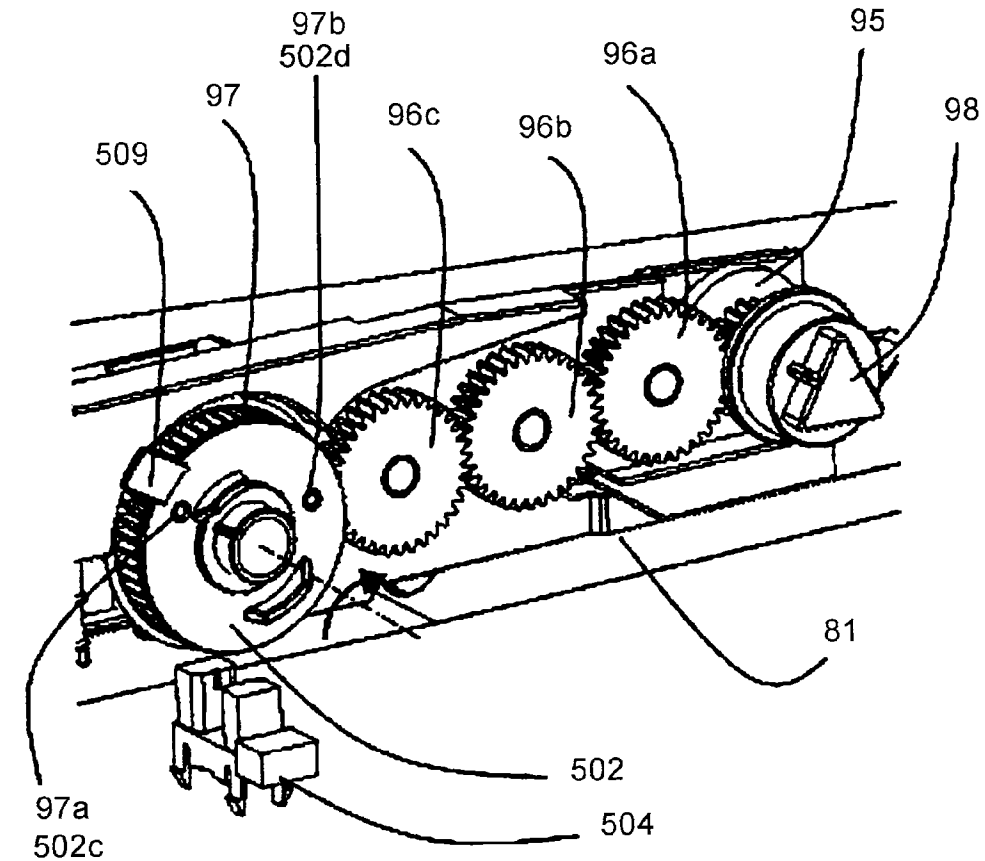
Figure 12B:
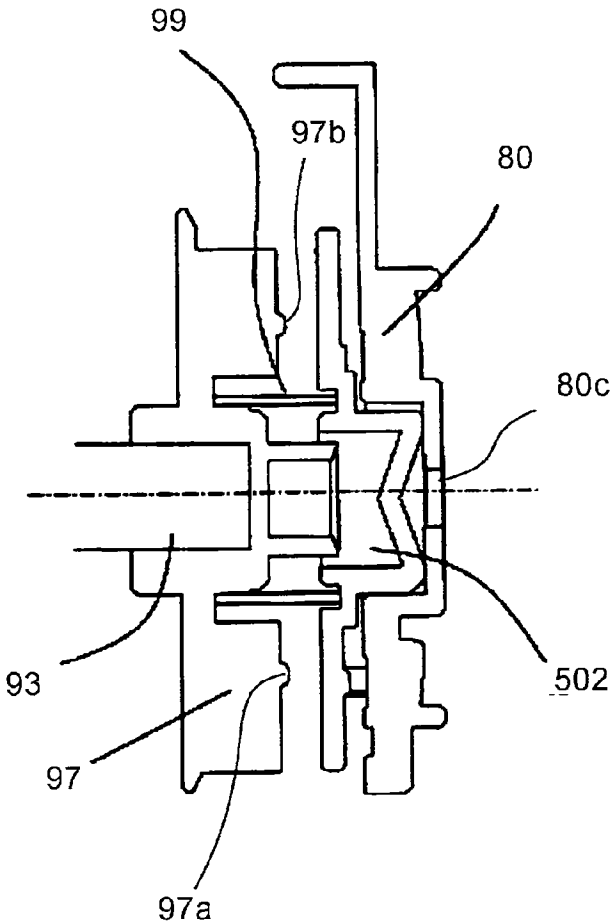
FIGS. 12A and 12B are views illustrating the new transfer belt unit detecting mechanism immediately after the switch from the detection of the new transfer belt unit to the detection of the old transfer belt unit.
Figure 12A:
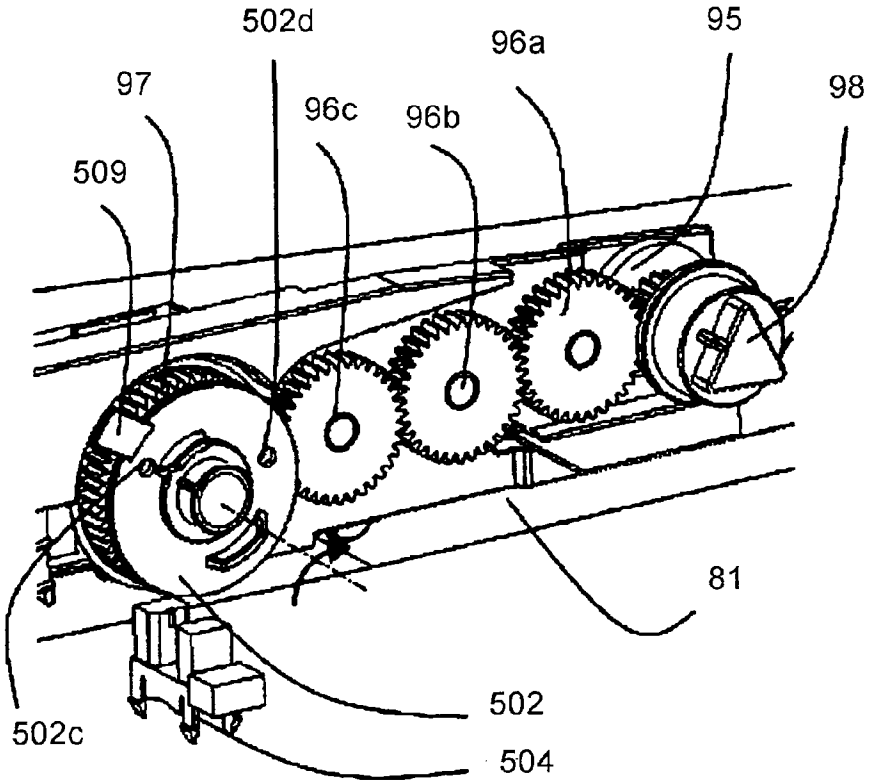

FIGS. 10A and 10B are views illustrating the new unit detecting member 502, the new unit detecting sensor 504 disposed in the vicinity of the new unit detecting member 502, and the drive train responsible for the abutment/separation of the intermediate transfer belt when the transfer belt unit 120 is new and in the full separation mode. In other words, FIGS. 10A and 10B illustrate the first state in which the flag portion 509 is detected by the new unit detecting sensor 504. Moreover, FIGS. 11A and 11B are views illustrating the status of the new unit detecting member 502 immediately before the new unit is consumed to become old. In other words, FIGS. 11A and 11B illustrate the second state in which the flag portion 509 is not detected by the new unit detecting sensor 504. Additionally, FIGS. 12A and 12B are views illustrating the status of the new unit detecting member 502 immediately after the new unit is consumed to become old. FIGS. 10A, 11A, and 12A are perspective views illustrating the vicinity of the third separation gear 97 and the new unit detecting member 502 whereas FIGS. 10B, 11B, and 12B are partial cross-sectional views illustrating the vicinity thereof.

When a new transfer belt unit 120 is installed, the intermediate transfer belt 12*e* is in the full separation mode. In addition, the holes 502*c* and 502*d* at the new unit detecting member 502 engage with the boss portions 97*a* and 97*b* at the third separation gear 97, so that the new unit detecting member 502 can be rotated in association with the third separation gear 97.

At this time, as illustrated in FIG. 10B, the cam portions 502*a* and 502*b* at the new unit detecting member 502 abut against a part of the frame 80 except the cam shaped portions 80*a* and 80*b*. As a consequence, the holes 502*c* and 502*d* cannot be detached from the boss portions 97*a* and 97*b* at the third separation gear 97 against the urging force of a compression spring 99. At this time, the flag portion 509 intercepts the light incident into the sensor 504 in a new unit detection state.

When the third separation gear 97 is rotated by ⅓ rotation (i.e., at an angle of 120°) from the above-described state (in a direction indicated by an arrow in FIG. 10A), the flag portion 509 cannot intercept the light incident into the sensor 504, and further, the mode is transited to the full abutment mode, as illustrated in FIGS. 11A and 11B. At this time, projections of the cam portions 502*a* and 502*b* at the new unit detecting member 502 rotated integrally with the third separation gear 97 engage to be fitted into recesses of the cam shaped portions 80*a* and 80*b* on the side of the frame 80. Consequently, the new unit detecting member 502 is moved by the resiliency of the compression spring 99 in a direction indicated by an arrow in FIG. 11B.

As a consequence, the new unit detecting member 502 is turned into the states illustrated in FIGS. 12A and 12B. Hence, the holes 502*c* and 502*d* at the new unit detecting member 502 are disengaged from the boss portions 97*a* and 97*b* at the third separation gear 97. Once the holes 502*c* and 502*d* are disengaged from the boss portions 97*a* and 97*b*, the rotational force cannot be transmitted to the new unit detecting member 502, and therefore, the cam portions 502*a* and 502*b* remain engaged with the cam shaped portions 80*a* and 80*b*. Thus, the new unit detecting member 502 and the third separation gear 97 are located at a non-association position at which they can never engage with each other, so that the new unit detecting member 502 is kept to be permanently housed inside the frame 80.

In this manner, an interception signal is never input into the new unit detecting sensor 504, and therefore, it can be determined whether the transfer belt unit 120 is new or old. Specifically, the first state is turned into the second state, and thereafter, the confirmation of the kept second state determines that the transfer belt unit 120 is an unused unit.

[New Unit Detection Invalidating Function]

As described above, in the case where a malfunction occurs in the image forming apparatus, it is necessary to inspect the cause of the malfunction by distinguishing the causes by the main body of the image forming apparatus and by the transfer belt unit. At this time, if a new transfer belt unit is carelessly detected, the use history of the transfer belt unit 120 used until then and at which no malfunction occurs actually may be accidentally erased.

In view of this, a restricting unit which restricts the new unit detecting member 502 from being moved to the non-association position is provided in the present embodiment, and further, a mode in which the new unit detection is invalidated (a troubleshooting mode) is provided for the transfer belt unit 120. A restricting configuration will be described below.

Figure 13B:
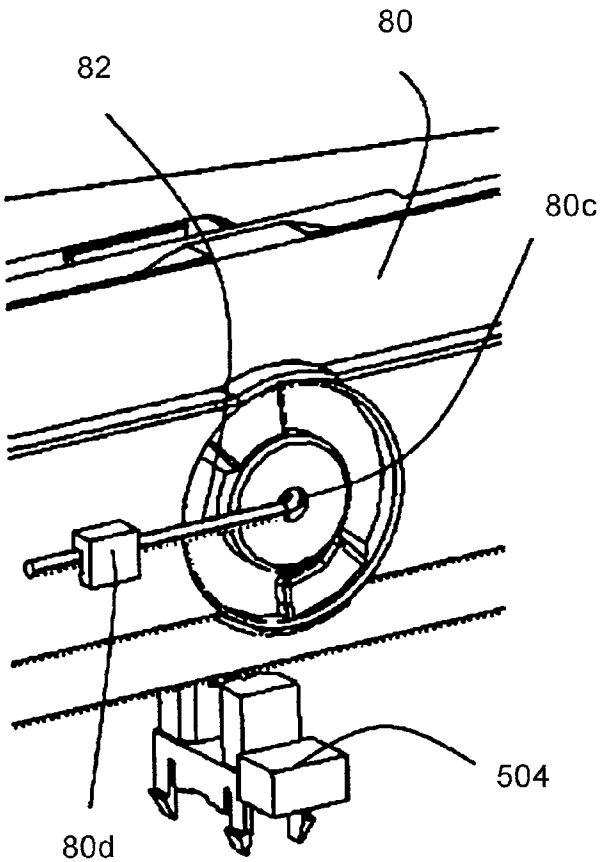
FIGS. 13A and 13B are views partially illustrating the outside appearance for achieving a new transfer belt unit detection invalidating function.
Figure 13A:
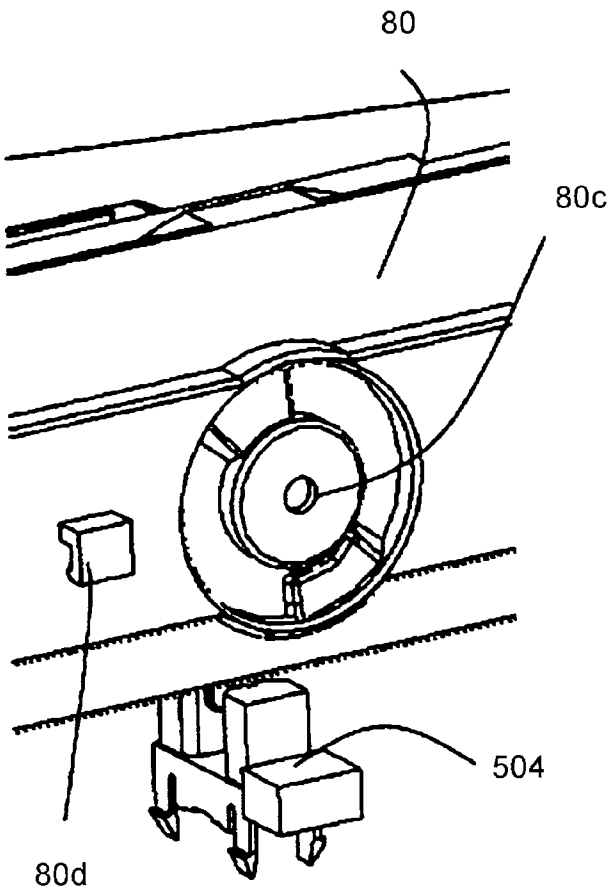

As illustrated in FIG. 13A, a detection preventing portion 80*c* and a hook portion 80*d* serving as fixing portions for use in fixing a detection preventing member 82 as a restricting member, as described later, are formed at a part of the frame 80 in the transfer belt unit. The detection preventing member 82 serves as the restricting member which restricts the new unit detecting member 502 from being moved to the above-described non-association position, and it is formed by bending an end of a rod-like member at a right angle. In other words, the restricting member inhibits the second state from being maintained.

Figure 14:
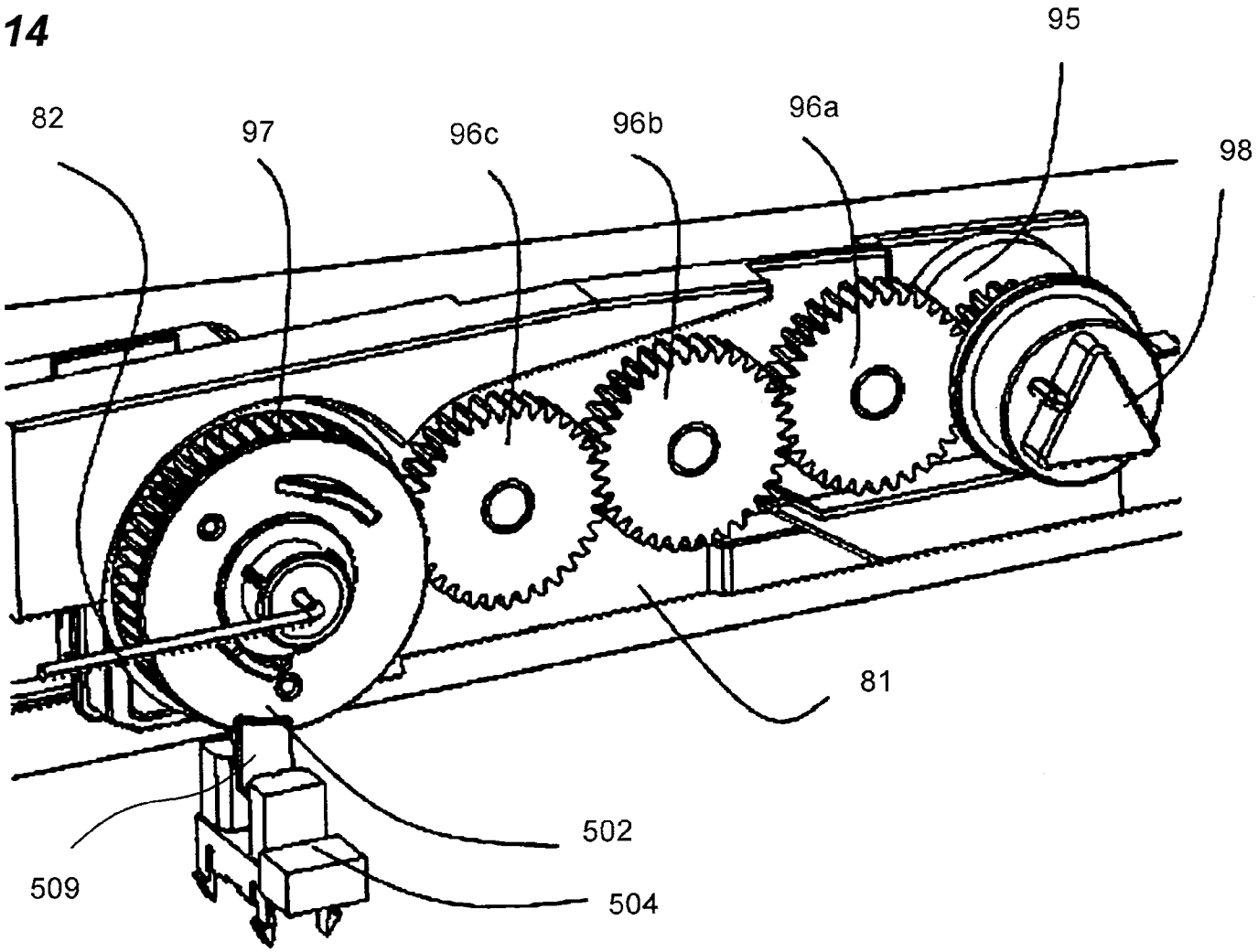
FIG. 14 is a view illustrating the inside configuration for achieving the new transfer belt unit detection invalidating function.

FIG. 13B illustrates a configuration in which the detection preventing member 82 is fixed to the detection preventing portion 80*c*. FIG. 14 is a view similar to FIG. 13B except the removal of the frame 80 for the sake of easy understanding.

As illustrated in FIG. 13A, the detection preventing portion 80*c* is a fixing hole bored at a position facing the new unit detecting member 502. The detection preventing member 82 is inserted at one end thereof into the fixing hole whereas it is locked at the other end thereof to the hook portion 80*d*.

As described above, when a new unit detection operation is performed in the state in which the detection preventing member 82 is fixed, the status is changed as follows: namely, the new unit detecting member 502 is to be moved rightward in FIG. 11B (in the direction of the rotary shaft, that is, a thrust direction) at the time of the transition from the state illustrated in FIGS. 11A and 11B to the state illustrated in FIGS. 12A and 12B, as described above. However, since the detection preventing member 82 is inserted into the detection preventing portion 80*c*, the new unit detecting member 502 cannot be moved in the thrust direction due to the abutment against the detection preventing member 82. Consequently, the new unit detecting member 502 is kept in engagement with the third separation gear 97.

Figure 15B:
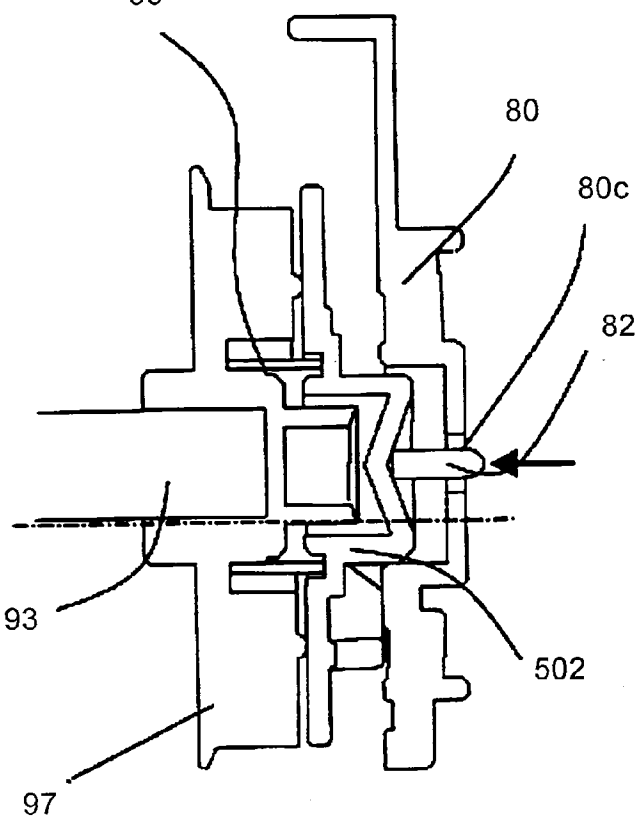
FIGS. 15A and 15B are a partially enlarged view and a partial cross-sectional view illustrating an intermediate transfer belt abutment/separation drive train in the full abutment mode in a new transfer belt unit detection invalidation state.
Figure 15A:
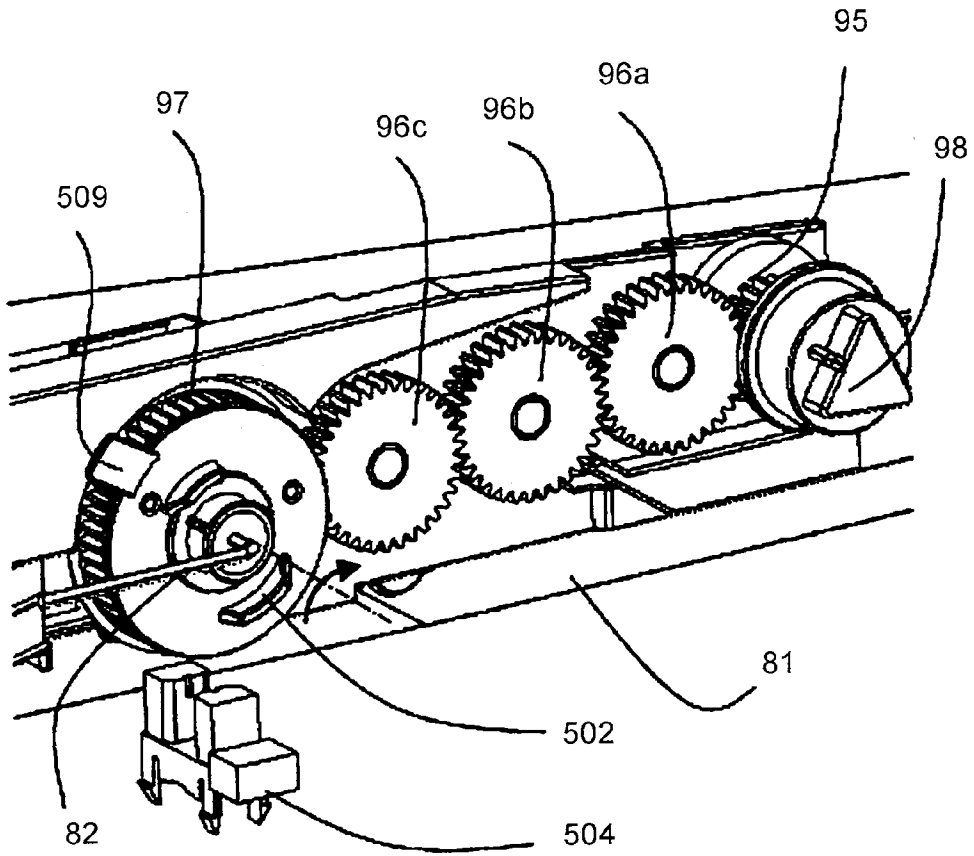
Figure 16:
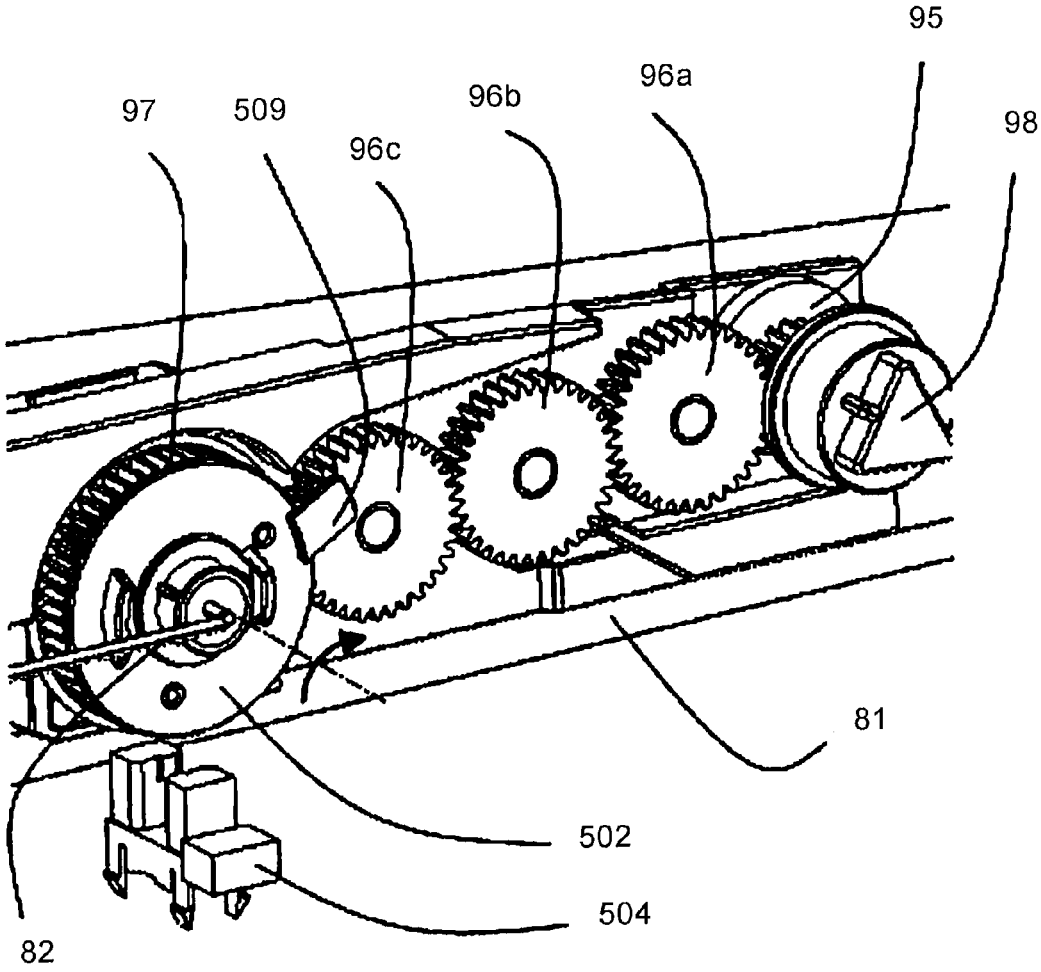
FIG. 16 is a partially enlarged view illustrating the intermediate transfer belt abutment/separation drive train in the monochromatic mode in the new transfer belt unit detection invalidation state.

Moreover, even in the case of the switch from the full color mode (i.e., a state illustrated in FIGS. 15A and 15B) to the monochromatic mode (i.e., a state illustrated in FIG. 16), the engagement is kept, so that the mode can be returned to the full separation mode (i.e., a home position) while the new unit is kept again. That is to say, in the case of the switch from the first state to the second state and the switch from the second state to the first state, the main body of the apparatus is inhibited from being set to image forming conditions which are set when the transfer belt unit 120 is an unused unit. This operation is performed together with a detection control, as described below, so that the new unit detection can be invalidated without any physical breakage of the new unit detecting mechanism, thereby achieving the troubleshooting mode.

Incidentally, as for the troubleshooting mode, in the case of the use while, for example, a member having the same function as that of the state change detection preventing member 82 remains fixed to the detection preventing portion 80*c*, the unit substantially consumed through the use may be accidentally detected as a new unit.

Figure 17:
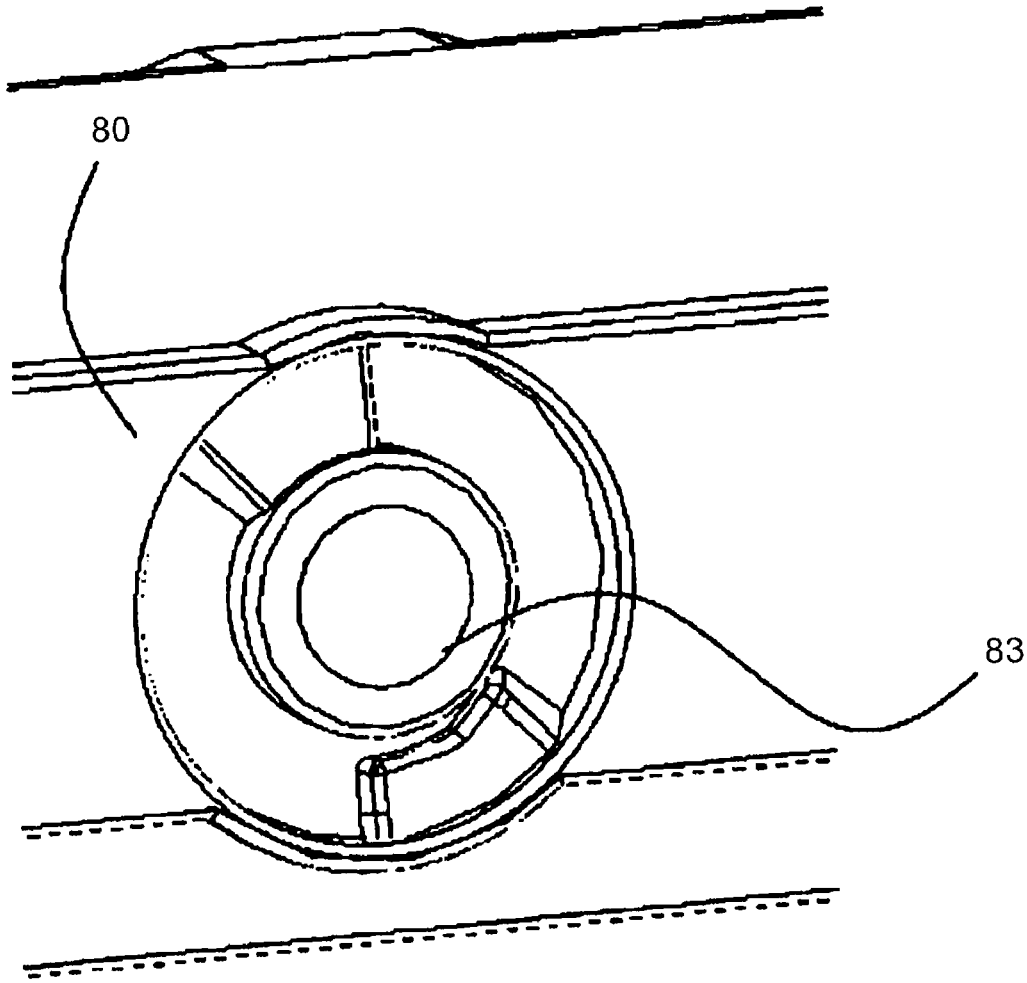
FIG. 17 is a view illustrating a configuration for preventing any falsification of detection of a new transfer belt unit.

To solve the above-described problem, a falsification preventing seal (i.e., a cover member) 83 on which a visual scar remains upon peel-off is stuck onto the detection preventing portion 80*c*, which is thus covered, as illustrated in, for example, FIG. 17. Thus, the scar of the peel-off of the seal remains, and further, an accident can be prevented by an alarm of, for example, "never insert member into hole" after peeling. Here, a well-known falsification preventing seal may be used.

[Control Relevant to Intermediate Transfer Belt Abutment/Separation Detection and New Unit Detection]

Figure 18:
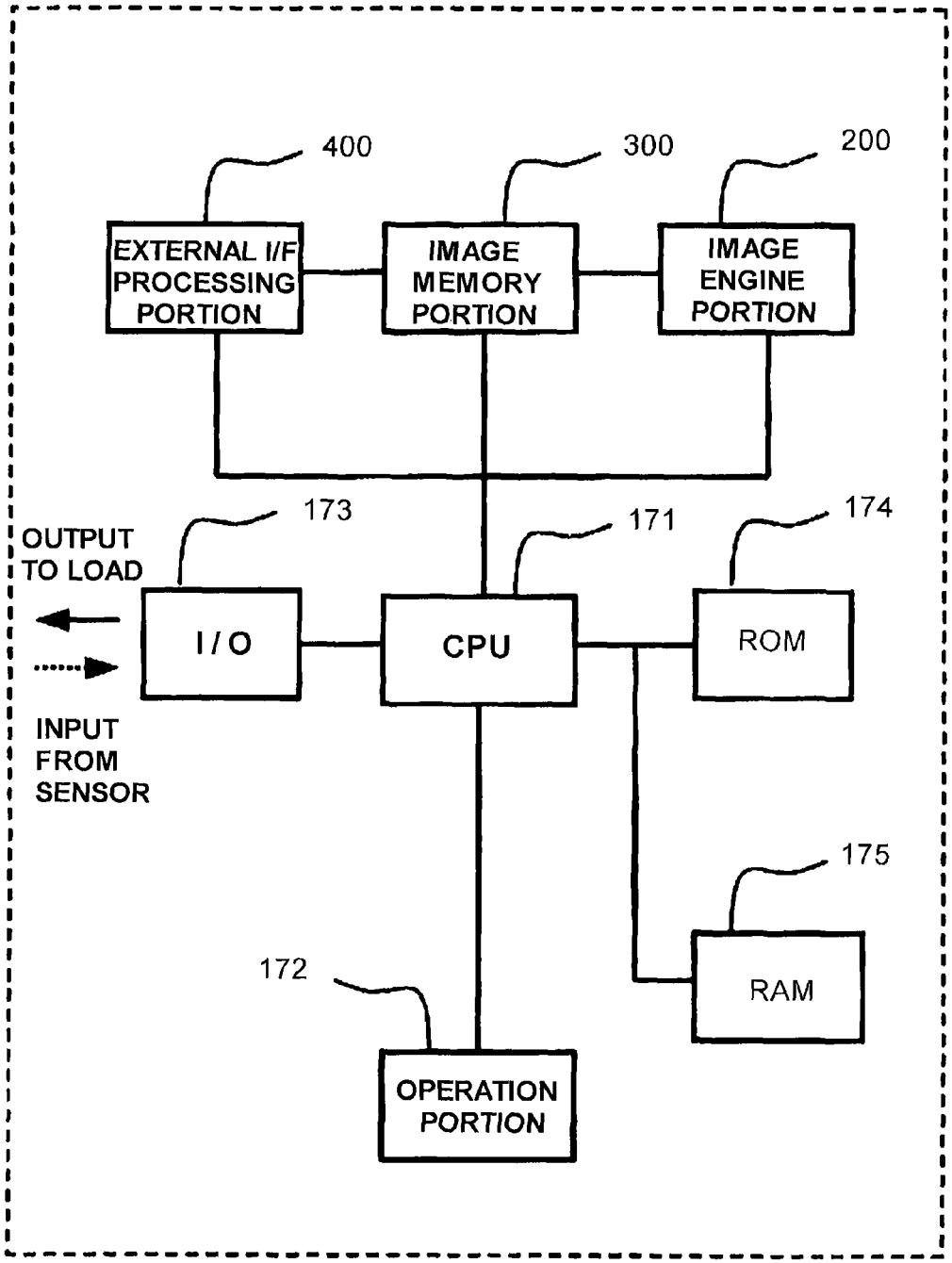
FIG. 18 is a control block diagram illustrative of a control of a color image forming apparatus.

FIG. 18 is a control block diagram illustrative of the control of the color image forming apparatus in the present embodiment. Connected to a CPU 171 which performs a basic control of the image forming apparatus 100 are a ROM 174, in which a control program is written, a work RAM 175 which performs processing, and an input/output port I/O 173 via address buses and a data bus, respectively. Connected to the input/output port I/O 173 are various kinds of loads (not illustrated) such as a motor and a clutch constituting the image forming apparatus and an input (not illustrated) from a sensor which detects the position of a sheet.

The CPU 171 controls input/output in sequence according to the contents of the ROM 174 via the input/output port I/O 173, so as to perform an image forming operation. Moreover, an operation portion 172 is connected to the CPU 171, thereby controlling a display unit and a key input unit in the operation portion 172. An operator instructs the CPU 171 of the image forming operation mode or the switch of the display via the key input unit, so that the CPU 171 displays the state of the image forming apparatus 100 or the operation mode set by the key input.

Connected to the CPU 171 are an external I/F processing portion 400 which transmits/receives image data, processing data and the like to/from external equipment, an image memory portion 300 which extends or temporarily stores the image, and an image engine portion 200 which performs processing so as to expose line image data transferred from the image memory portion 300 by the scanner unit 3.

Figure 19:
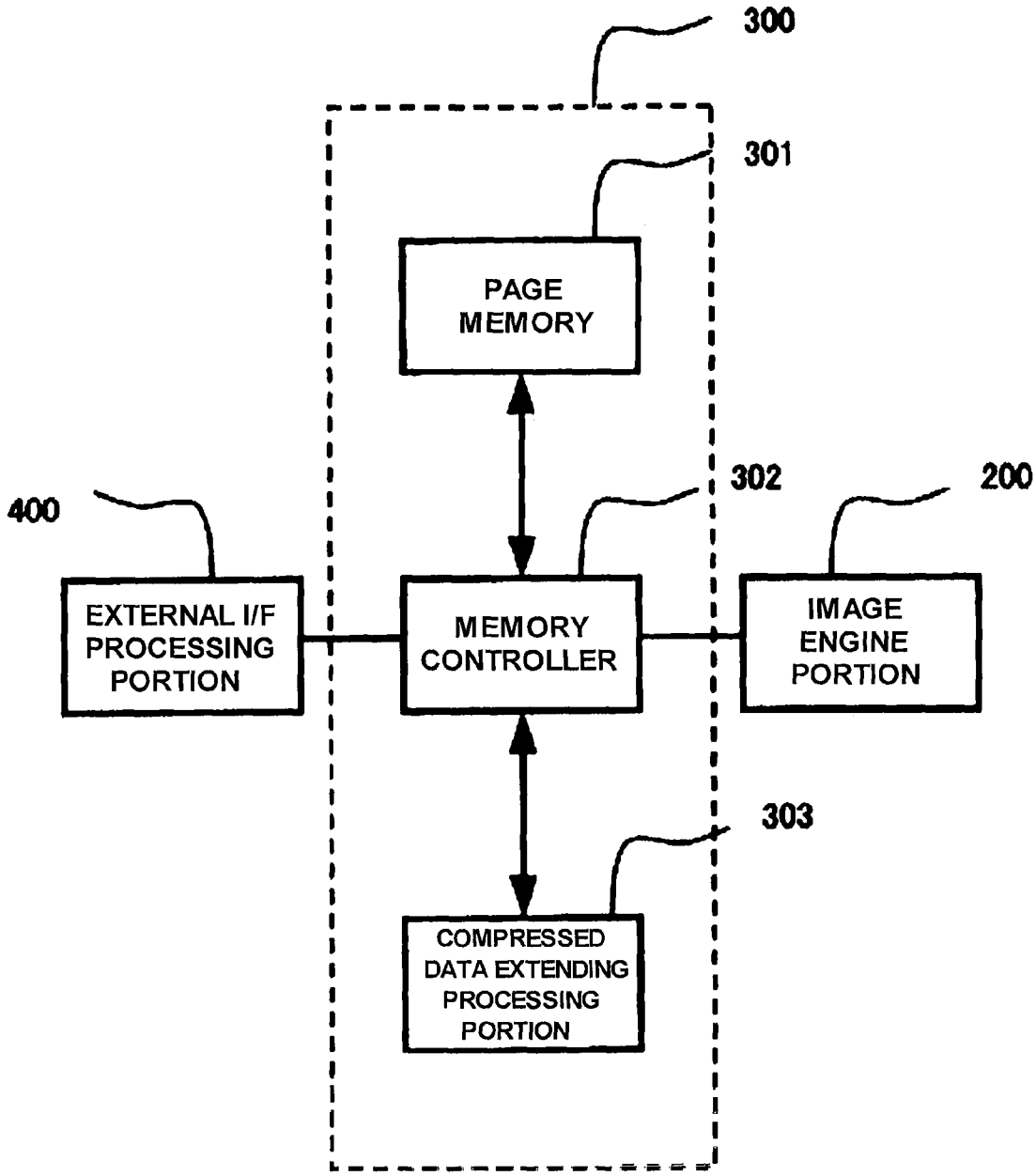
FIG. 19 is a control block diagram illustrative of an image memory portion.

FIG. 19 is a control block diagram illustrative of the image memory portion 300 in the present embodiment. The image memory portion 300 makes access to the image input/output such that the image data received from the external I/F processing portion 400 is written in a page memory 301 constituted of a memory such as a DRAM via a memory controller 302, and further, reads the image to the image engine portion 200. The memory controller 302 determines whether or not the image data received from the external equipment, that is, the external I/F processing portion 400 is compressed data. If it is determined that the image data is compressed data, the data is extended by the use of a compressed data extending processing portion 303, and then, the data is written in the page memory 301 via the memory controller 302.

The memory controller 302 generates a DRAM refresh signal in the page memory 301, and further, adjusts access to the page memory 301 according to the writing from the external I/F processing portion 400 and the reading to the image engine portion 200. Moreover, the memory controller 302 controls a writing address to the page memory 301, a reading address from the page memory 301, and a reading direction in accordance with the instruction from the CPU 171.

Figure 20:
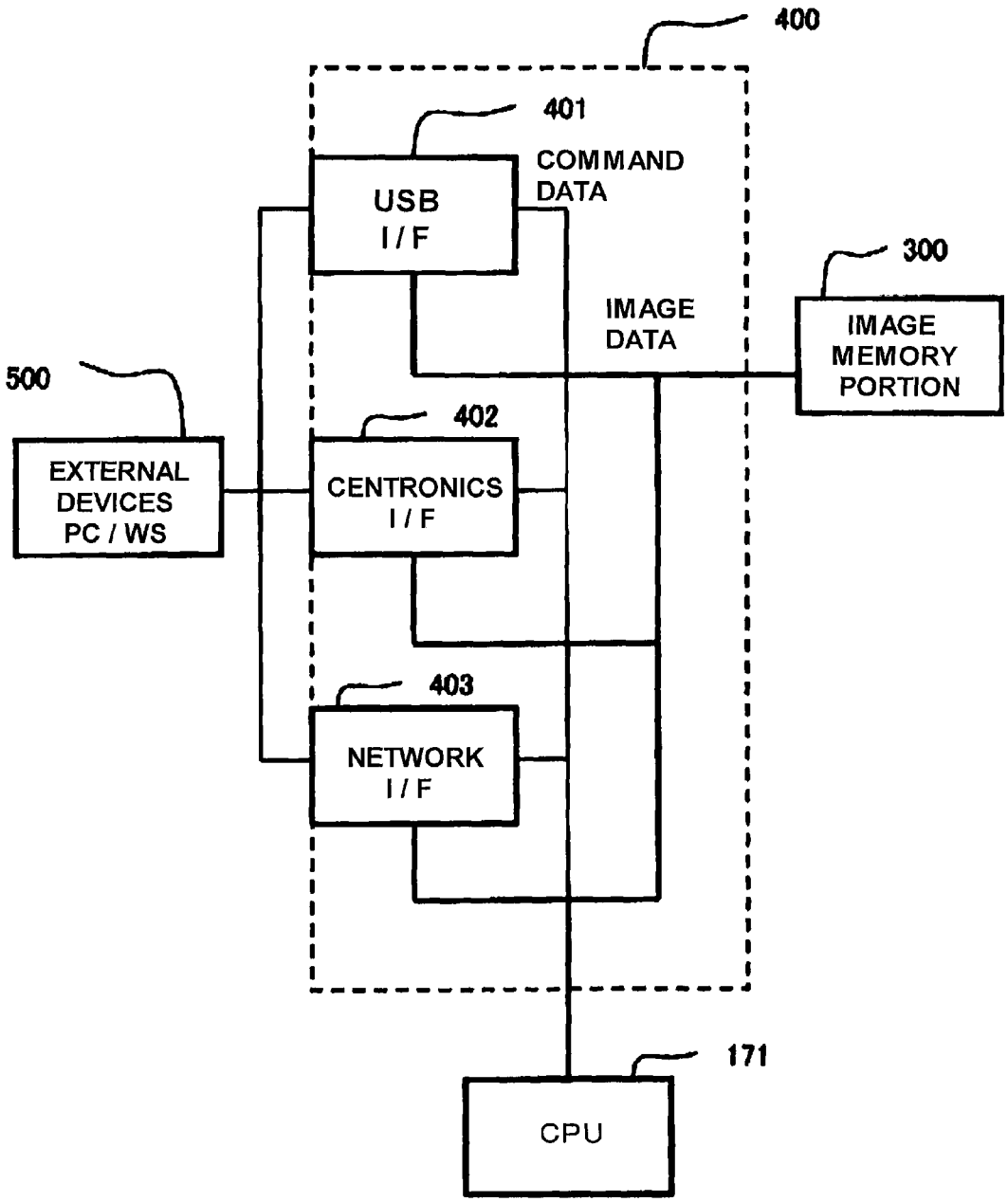
FIG. 20 is a diagram illustrating a configuration of an external I/F processing portion.

The configuration of the external I/F processing portion 400 will be described with reference to FIG. 20. The external I/F processing portion 400 receives the image data and print command data which are transmitted from external devices 500 via any one of a USB I/F 401, a Centronics I/F 402, and a network I/F 403. In addition, the external I/F processing portion 400 transmits status information on the image forming apparatus, which is determined by the CPU 171, to the external devices 500.

The external device 500 is exemplified by a computer or a work station. The print command data received from the external device 500 via any one of the USB I/F 401, the Centronics I/F 402, and the network I/F 403 is processed in the CPU 171. Setting conditions or timing of the print operation are produced by using the image engine portion 200 or the input/output port I/O 173. In contrast, the image data received from the external device 500 via any one of the USB I/F 401, the Centronics I/F 402, and the network I/F 403 is transmitted to the image memory portion 300 in accordance with the timing based on the print command data. Hence, the data is processed so as to form the image in the image forming portion.

Figure 21:
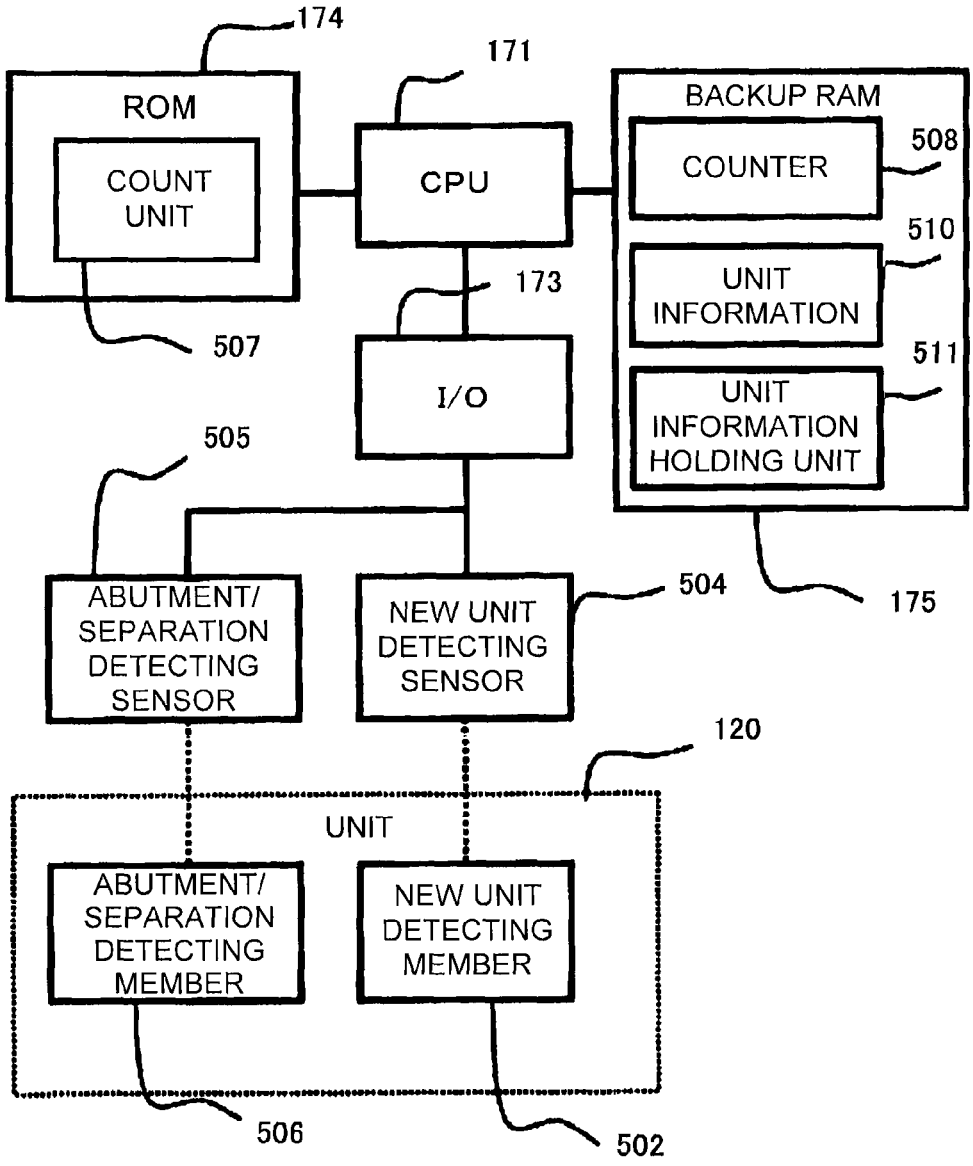
FIG. 21 is a diagram illustrating a configuration of an image forming system.

FIG. 21 is a diagram illustrating the configuration of an image forming system in the present embodiment. The transfer belt unit 120 is constituted of the intermediate transfer belt 12*e*, the drive roller 12*f*, the secondary transfer counter roller 12*g*, the tension roller 12*h*, and the primary transfer rollers 12*a*, 12*b*, 12*c*, and 12*d*.

The new unit detecting member 502 in the transfer belt unit is located at the end of the transfer belt unit 120.

The new unit detecting sensor 504 is adapted to detect penetration or interception in an optical sensor, as described above. The new unit detecting member 502 varies an output from the sensor 504 in a predetermined mode, so as to determine whether the transfer belt unit 120 is new or old. The CPU 171 is notified of a result detected by the new unit detecting sensor 504 through the input/output port 173.

The abutment/separation detecting sensor 505 is adapted to detect the abutment/separation state of the intermediate transfer belt 12*e* against/from the drum.

A count unit 507 is designed to count the consumption of the transfer belt unit 120. The consumption is exemplified by an accumulated print amount from zero in a new transfer belt unit 120 up to then (a print dot amount added with a print ratio, i.e., a so-called pixel count) or an image formation time (an operation time). The count is stored in a counter 508.

Unit information 510 is parameters for use in forming an image according to characteristics of the transfer belt unit 120. The unit information 510 is determined in accordance with the result of initialization performed when an image forming unit 501 is first installed in the image forming apparatus. In the present embodiment, a transfer voltage/current is controlled. The transfer voltage/current of the primary transfer portion or the secondary transfer portion is controlled according to a change in resistance when the intermediate transfer belt 12*e*, the primary transfer rollers 12*a*, 12*b*, 12*c*, and 12*d*, and the driven roller 12*g* are used for a long period of time, thereby providing a desired transfer condition.

The unit information 510 is stored in a non-volatile RAM region inside of the image forming apparatus. A unit information holding unit 511 is adapted to store (retract) the unit information 510 which has been used (disposed) for a predetermined period in the case of the replacement of the transfer belt unit 120. The unit information holding unit 511 is stored in the non-volatile RAM region inside of the image forming apparatus, like the unit information 510.

Figure 22:
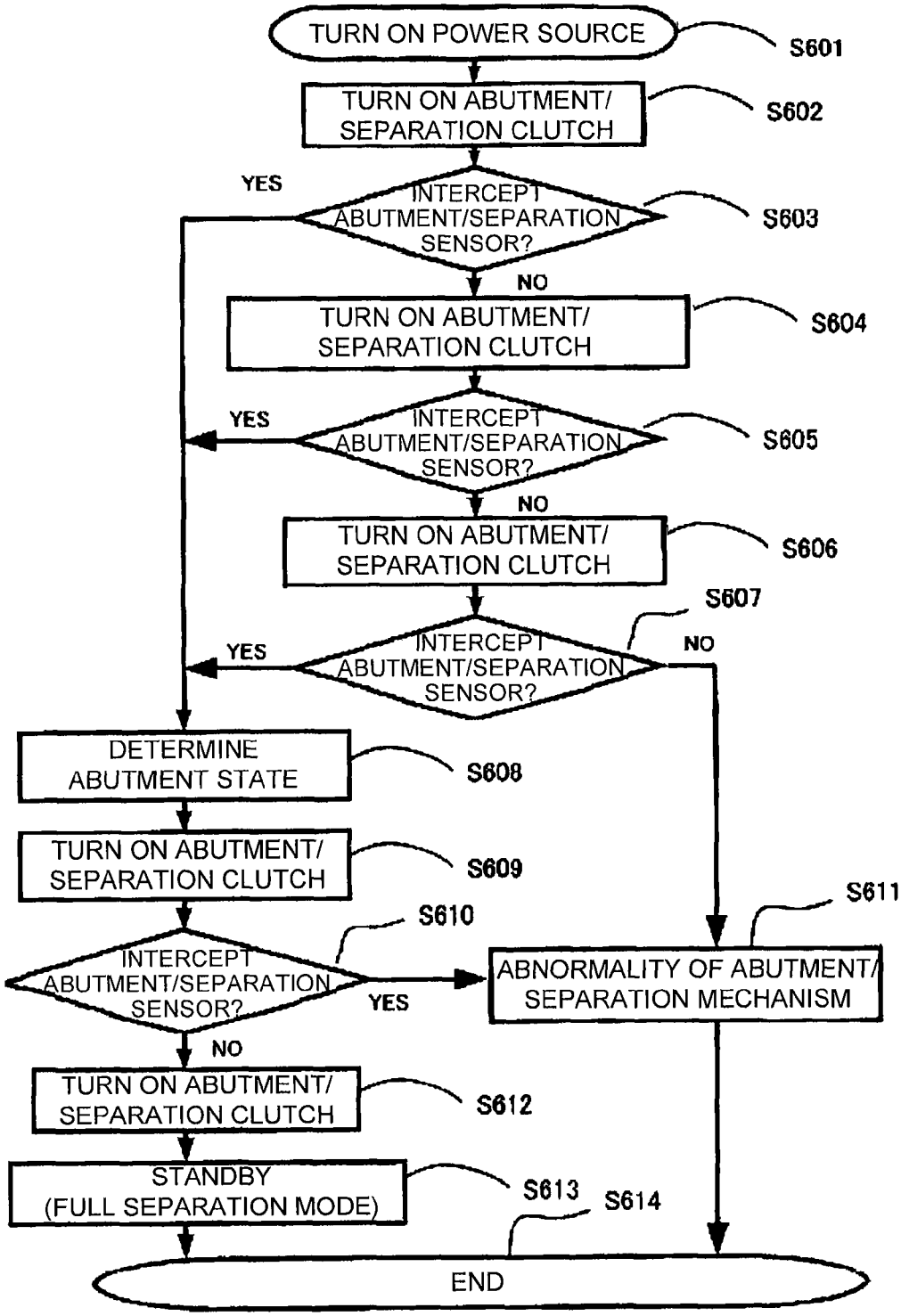
FIG. 22 is a flowchart illustrating intermediate transfer belt abutment/separation detection.

Next, a description will be given of detection and control relevant to an operation for identifying new and old units. For the sake of prevention of complicated description, FIG. 22 is a flowchart illustrating the abutment/separation detection by the transfer belt unit 120 in the present basic image forming apparatus before the description of the operation for identifying the new and old units.

The transfer belt unit 120 is not always in the full separation mode, that is, at its home position due to an abrupt stoppage of a supply power source. After power ON (S601), the abutment/separation operation is repeated until the abutment/separation detecting sensor 505 detects the interception, that is, reaches the full abutment mode, thereby grasping the state in any one of the full separation mode, the full abutment mode, and the monochromatic mode (S602 to S607). Thereafter, it is determined whether or not the abutment/separation detecting sensor 505 per se is out of working order (S608 to S610), thereby returning to the full separation mode. In this manner, the detection comes to an end (S612 to S614).

Figure 23:
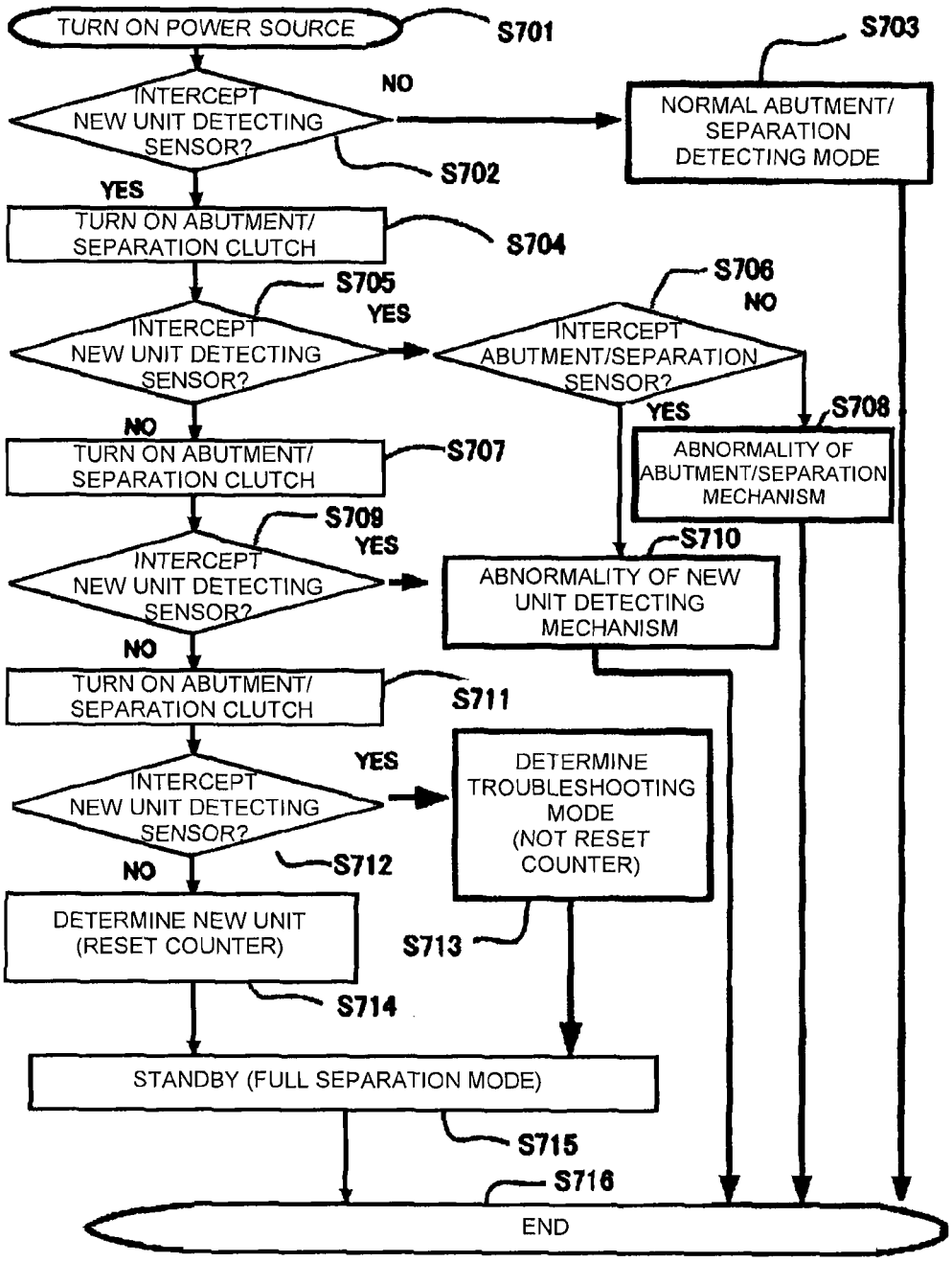
FIG. 23 is a flowchart illustrating detection of a new transfer belt unit.

FIG. 23 is a flowchart illustrating a new unit identifying (new unit detecting) operation of the transfer belt unit 120 in the present image forming apparatus and identifying operation in the new unit detection invalidating mode (i.e., in the troubleshooting mode).

In step S701, the power source is turned on in the image forming apparatus, and then, the new unit detecting sensor 504 first performs the detection in step S702. In the case where the new unit detecting sensor 504 is not intercepted by the new unit detecting member 502, only the abutment/separation detecting mode is carried out (S703).

In contrast, in the case where the new unit detecting sensor 504 is intercepted by the new unit detecting member 502 in step S702, the unit 120 is in the full separation mode except the malfunction of the sensor, so that the abutment and separation modes are switched until the mode becomes the full separation mode again. At this time, the malfunction of the sensor 504 is appropriately screened (S704 to S711).

In step S712, in the case of the penetration in the new unit detecting sensor 504, it is determined that the transfer belt unit 120 is new, thereby clearing the counter 508, followed by the initialization for determining the unit information 510 for achieving the image formation according to the characteristics of the transfer belt unit 120. Upon the completion of the initialization, the image forming apparatus stands by (S714 and S715).

In contrast, in the case of the interception in the new unit detecting sensor 504 in step S712, it is determined that the transfer belt unit 120 is in the new unit detection invalidating mode. Thereafter, the transfer belt unit 120 may remain consumed without any replacement or may be replaced with another consumed image forming unit 501, although very rarely presumed. In view of this, the unit information 510 is not updated, so that the image forming apparatus stands by (S713 to S715). At this time, the troubleshooting mode may be displayed on the operation portion 172. In this manner, the detection comes to an end (S716).

Here, the counter 508 in the transfer belt unit 120 is operated as follows.

In the image forming apparatus, the count in the counter 508 is updated every image formation. Upon the completion of the image formation, the CPU 171 and the ROM 174 determine whether or not the count in the counter 508 reaches a predetermined value or more. If it is determined that the count is the predetermined value or more, a user is alerted to a given matter such as a replacement timing of the transfer belt unit 120 by displaying it on the operation portion 172. Simultaneously with the alert display, an image forming operation thereafter is limited, to be thus controlled to keep a good quality of an image. Like in the present embodiment, in the case where the transfer belt unit 120 is determined to be new (S714), the counter 508 is reset, thereby starting to record the use history of the unit again.

In the above-described present embodiment, the image forming apparatus 100 is applied to the image forming apparatus in which the toner images formed on the plurality of photosensitive drums 1 are primarily transferred onto the intermediate transfer belt 12*e*, and then, the toner images are secondarily transferred onto the transfer material conveyed.

However, the present invention is not limited to the image forming apparatus which uses the intermediate transfer belt 12*e*. The present invention may be applied to, for example, an image forming apparatus in which a transfer material conveying belt serving as the transfer material bearing member for bearing the transfer material is disposed in such a manner as to freely abut against or be separated from a plurality of image bearing members, and thus, toner images are transferred in sequence onto a transfer material P to be conveyed by the transfer material conveying belt, thereby forming a recording image.

By way of the above-described embodiment, the description has been given of the example in which the first state is shifted to the second state, and then, the second state is maintained. Here, the present invention may be applied to an example in which the second state is shifted to the first state, and then, the first state is maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-120916, filed May 7, 2008, which is hereby incorporated by reference herein in its entirety.

What is claimed is:

1. An image forming apparatus comprising:

an image bearing member which bears toner images; and a detachable unit configured to detachably attach to a main body of the image forming apparatus, wherein said detachable unit includes a first rotary member and a second rotary member, said first rotary member is configured to rotate by transmission of a driving force and said second rotary member, having a portion to be detected, is configured to separably contact with said first rotary member, and wherein said second rotary member separates from said first rotary member when said first rotary member rotates under a condition said second rotary member contacts with said first rotary member, wherein said detachable unit further includes a restricting member configured to restrict a position of said second rotary member to contact with said first rotary member and configured to keep contact between said first rotary member and said second rotary member even when said first rotary member rotates while said restricting member restricts the position of said second rotary member, wherein it is determined that said detachable unit is in an unused state when a first state, in which said portion to be detected is detected, is determined, and after the first state is determined, a second state, in which said portion to be detected is not detected, is determined, wherein after it is determined that said detachable unit is in the unused state, either the first state or the second state is maintained, and wherein the first state and the second state can be switched by selecting a contacting state and a separating state between said first rotary member and said second rotary member.

2. The image forming apparatus according to claim 1, wherein said detachable unit includes a fixing portion to which said restricting member is fixed, said fixing portion being covered with a covering member.

3. The image forming apparatus according to claim 1, wherein said detachable unit has a belt which is adapted to transfer the toner images borne on said image bearing member onto a recording material.

4. The image forming apparatus according to claim 3, wherein said belt can abut against or be separated from said image bearing member, and wherein said portion to be detected moves in association with the abutment/separation of said belt.

5. The image forming apparatus according to claim 3, wherein said belt is an intermediate transfer belt.

6. The image forming apparatus according to claim 1, wherein a side surface of said first rotary member and a side surface of said second rotary member are contactable with each other.

7. The image forming apparatus according to claim 6, wherein said first rotation member has a boss portion on said side surface of the first rotary member and said second rotation member engages with said boss portion when said second rotation member contacts with said first rotation member.

8. The image forming apparatus according to claim 1, wherein a biasing portion is provided between said first rotary member and said second rotary member.

9. The image forming apparatus according to claim 8, wherein said restricting member keeps said second rotary member in contact with said first rotary member against an urging force of said biasing member.

10. The image forming apparatus according to claim 1, wherein said second rotary member separates from said first rotary member for switching from the first state to the second state.

11. The image forming apparatus according to claim 1, further comprising:

a frame which can hold said second rotary member separate from said first rotary member.

12. A detachable unit configured to detachably attach to an image forming apparatus, comprising:

a first rotary member configured to rotate by transmission of a driving force;

a second rotary member, having a portion to be detected, configured to separably contact with said first rotary member, wherein said second rotary member separates from said first rotary member when said first rotary member rotates under a condition said second rotary member contacts with said first rotary member; and a restricting member configured to restrict a position of said second rotary member to contact with said first rotary member and configured to keep contact between said first rotary member and said second rotary member even when said first rotary member rotates while said restricting member restricts the position of said second rotary member, wherein it is determined that said detachable unit is in an unused state when a first state, in which said portion to be detected is detected, is determined, and after the first state is determined, a second state, in which said portion to be detected is not detected, is determined, wherein after it is determined that said detachable unit is in the unused state, either the first state or the second state is maintained, and wherein the first state and the second state can be switched by selecting a contacting state and a separating state between said first rotary member and said second rotary member.

13. The detachable unit according to claim 12, further comprising:

a fixing portion to which said restricting member is fixed, said fixing portion being covered with a covering member.

14. The detachable unit according to claim 12, further comprising:

a belt which is adapted to transfer toner images borne on an image bearing member onto a recording material.

15. The detachable unit according to claim 14, wherein said belt can abut against or be separated from the image bearing member, wherein said portion to be detected moves in association with the abutment/separation of said belt.

16. The detachable unit according to claim 14, wherein said belt is an intermediate transfer belt.

17. The detachable unit according to claim 12, wherein a side surface of said first rotary member and a side surface of said second rotary member are contactable with each other.

18. The detachable unit according to claim 12, wherein said first rotation member has a boss portion on said side surface of said first rotation member and said second rotation member engages with said boss portion when said second rotation member contacts with said first rotation member.

19. The detachable unit according to claim 12, further comprising:

a biasing portion provided between said first rotary member and said second rotary member.

20. The detachable unit forming apparatus according to claim 12, wherein said second rotary member separates from said first rotary member for switching from the first state to the second state.

21. The detachable unit according to claim 12, further comprising:

a frame which can hold said second rotary member separate from said first rotary member.

* * * * *